US005192651A

United States Patent [19]

Tsukahara et al.

[11] Patent Number: 5,192,651

[45] Date of Patent: Mar. 9, 1993

[54] SILVER HALIDE COLOR PHOTOGRAPHIC PHOTOSENSITIVE MATERIALS CONTAINING AT LEAST TWO TYPES OF CYAN DYE FORMING COUPLERS

[75] Inventors: Jiro Tsukahara; Hidetoshi Kobayashi, both of Kanagawa, Japan

[73] Assignee: Fuji Photo Film Co. Ltd., Kanagawa, Japan

[21] Appl. No.: 630,257

[22] Filed: Dec. 19, 1990

[30] Foreign Application Priority Data

Dec. 20, 1989 [JP] Japan ..... 1-330766

[51] Int. Cl.[5] ..... G03C 7/34

[52] U.S. Cl. ..... 430/549; 430/552; 430/553

[58] Field of Search ..... 430/549, 552, 553

[56] References Cited

U.S. PATENT DOCUMENTS 4,333,999 6/1982 Lau ..... 430/17
4,865,959 9/1989 Sakanoue et al. ..... 430/548

FOREIGN PATENT DOCUMENTS 0073145 3/1983 European Pat. Off. ..... 430/553
0112514 7/1984 European Pat. Off. ..... 430/549
0116428 8/1984 European Pat. Off. ..... 430/553
0159190 10/1985 European Pat. Off. ..... 430/549
59-24848 2/1984 Japan .

OTHER PUBLICATIONS

Chemical Abstracts, vol. 105, No. 18, Abstract No. 162150n.
Chemical Abstracts, vol. 101, Abstract No. 46212c, 1984.

*Primary Examiner*—Lee C. Wright
*Attorney, Agent, or Firm*—Birch, Stewart, Kolasch & Birch

[57] ABSTRACT

The present invention relates to photographic photosensitive material comprising a support having thereon at least one silver halide emulsion layer. The photosensitive material contains at least one cyan dye forming coupler represented by formula (I)

and at least one cyan dye forming coupler represented by formula (II)

in proportions, respectively from 20 to 99 wt % and from 1 to 80 wt %, wherein all the symbols are defined in the specification.

18 Claims, No Drawings

SILVER HALIDE COLOR PHOTOGRAPHIC PHOTOSENSITIVE MATERIALS CONTAINING AT LEAST TWO TYPES OF CYAN DYE FORMING COUPLERS

FIELD OF THE INVENTION

This invention concerns silver halide color photographic photosensitive materials which contain novel phenol type cyan dye forming couplers.

BACKGROUND OF THE INVENTION

After exposing a silver halide photographic photosensitive material, the colored image is formed by a reaction between the primary aromatic amine developing agent which has been oxidized by color development and a dye forming coupler (referred to hereinafter as a "coupler"). In general, yellow, magenta and cyan colored images which have a complementary color relationship are used to reproduce blue, green and red using the subtractive method of color reproduction. Phenol derivatives or naphthol derivatives are often used as couplers for forming a cyan image. In color photography, the color forming couplers may be added to the developer or they may be incorporated in a photosensitive photographic emulsion layer or another color image forming layer, and a non-diffusible dye is formed by reaction with the oxidized form of a color developing agent which is formed by development.

The reaction between the coupler and the color developing agent occurs at the active site of the coupler. Couplers which have a hydrogen atom at the active site are four equivalent couplers, which is to say, stoichiometrically, they require 4 mol of silver halide with development nuclei in order to form 1 mol of dye. On the other hand, couplers which have a group which can be eliminated as an anion at the active site are two equivalent couplers, which is to say these couplers only require stoichiometrically 2 mol of silver halide which has development nuclei to form 1 mol of dye. Thus, the amount of silver halide in the photosensitive material can generally be reduced and the film thickness can be reduced relative to that when a four equivalent coupler is used, the processing time for the photosensitive material can be shortened and the sharpness of the colored image which is formed is also improved.

Of these cyan couplers, the absorption of the dye which is formed using naphthol type couplers is at a sufficiently long wavelength and there is little overlap with the absorption of the magenta dye image. Moreover since these couplers have a low to a high coupling activity with the oxidized form of a color developing agent they are widely used in photographic applications centered around color negative films. However, the dye images obtained from naphthol type couplers are reduced by ferrous ions which accumulate in fatigued bleach baths and bleach-fix baths and tend to fade (this is known as "reduction fading") and the fastness of the image to heat is poor. As a result, there is a great demand for improvement.

On the other hand, phenol type cyan couplers which have a p-cyanophenylureido group in the 2-position and a carbonamido group which is a ballast group (a group which renders the molecule resistant to diffusion) in the 5-position (referred to hereinafter as ureido cyan couplers) are disclosed in U.S. Pat. No. 4,333,999. The dye formed using these couplers has a deep color shifted by association in the film and they provide colored images which have an excellent hue and provide excellent fastness. As a result, they are now being used widely as couplers to replace the above-described naphthol type cyan couplers.

However, couplers which have a p-cyanophenylureido group in the 2-position and a ballast group in the 5-position generally suffer from the disadvantage that they are readily precipitated. For example, in many cases precipitation occurs during coupler dispersion or when a coupler dispersion is aged in cold storage, and this is a problem in practice. A method in which a specified high boiling point solvent is used in combination is disclosed in JP-A-59-24848, and a method in which amide compounds and non-color forming phenols are used in combination is disclosed in JP-A-61-36746 as ways of overcoming this problem of precipitation. (The term "JP-A" used herein signifies an "unexamined published Japanese patent application".)

However, the performance required of the latest photographic photosensitive materials is even more demanding and the need for higher coupling reactivities and higher dye absorption densities with these couplers continues.

Furthermore, the problem of coupler precipitation described above is clearly a major problem not just during the manufacture of the photographic photosensitive material but also in the manufactured product. More specifically, when a photosensitive material which contains a ureido cyan coupler is stored for a long period under conditions of high temperature and humidity, sometimes the color forming ability falls due to the precipitation of the coupler and this is extremely undesirable in a photosensitive material.

SUMMARY OF THE INVENTION

Hence, an object of the present invention is to provide silver halide color photographic photosensitive materials containing cyan couplers which have a high coupling reactivity and which provide a high dye absorption density, and with which there is no problem with coupler precipitation of the type described above.

As a result of thorough research carried out to achieve the above-described objective, the inventors have discovered that the objective can be achieved with the silver halide color photographic photosensitive material indicated below.

That is to say, the present invention provides a photographic photosensitive material comprising a support having thereon at least one silver halide emulsion layer, wherein at least one cyan dye forming coupler represented by the formula (I) indicated below

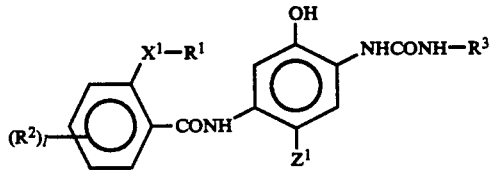

(I)

and at least one cyan dye forming coupler represented by the formula (II) indicated below

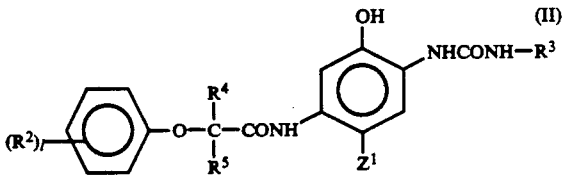

(II)

are present in the proportions, respectively, from 20 to 99 wt % and from 1 to 80 wt %, wherein in the formulae (I) and (II) $R^1$ represents a substituted or unsubstituted alkyl group, alkenyl group, alkynyl group, cycloalkyl group or aryl group, $X^1$ represents a single bond, —O—, —S—, —SO—, —$SO_2$—, —COO—, $$-\underset{\underset{R^6}{|}}{CON}-,\quad -SO_2O-,\quad -\underset{\underset{R^6}{|}}{SO_2N}-\quad \text{or}\quad -\underset{\underset{R^7}{|}}{N}-,$$

$R^2$ represents a group which can be substituted on a benzene ring, l represents an integer from 0 to 4, $R^3$ represents a substituted or unsubstituted aryl group, $R^4$ and $R^5$ each independently represent a hydrogen atom, an alkyl group, an alkenyl group, an alkynyl group, a cycloalkyl group, an acyl group, an alkoxycarbonyl group or an aryl group, and $Z^1$ represents a hydrogen atom or a coupling-off group, and $R^6$ represents a hydrogen atom, an acyl group or a group which has the same meaning as $R^1$, and $R^7$ has the same meaning as $R^1$ or represents a hydrogen atom.

DETAILED DESCRIPTION OF THE INVENTION

The cyan dye forming couplers represented by formula (I) and (II) are described in detail below.

In formula (I), $R^1$ preferably represents a linear chain or branched chain alkyl group which has a total number of carbon atoms (referred to hereinafter as the C number) of from 1 to 36 (and most preferably from 6 to 24), a linear chain or branched chain alkenyl of C number from 2 to 36 (and most preferably from 6 to 24), a linear chain or branched chain alkynyl group of C number from 2 to 36 (and most preferably from 6 to 24), a three to twelve membered cycloalkyl group of C number from 3 to 36 (and most desirably from 6 to 24) or an aryl group of C number from 6 to 36 (and most preferably from 6 to 24), and these groups may be substituted with substituent groups (for example, halogen atoms, hydroxyl groups, carboxyl groups, sulfo groups, cyano groups, nitro groups, amino groups, alkyl groups, alkenyl groups, alkynyl groups, cycloalkyl groups, aryl groups, alkoxy groups, aryloxy groups, alkylthio groups, arylthio groups, alkylsulfonyl groups, arylsulfonyl groups, acyl groups, acyloxy groups, alkoxycarbonyl groups, aryloxycarbonyl groups, carbonamido groups, sulfonamido groups, carbamoyl groups, sulfamoyl groups, ureido groups, alkoxycarbonylamino groups, sulfamoylamino groups, alkoxysulfonyl groups, imido groups or heterocyclic groups, these substituent groups being referred to as group A substituent groups). $R^1$ is preferably a linear chain or branched chain unsubstituted alkyl group or an alkyl group which has substituent groups (for example, alkoxy groups, alkylthio groups, aryloxy groups, arylthio groups, alkylsulfonyl groups, arylsulfonyl groups, aryl groups, alkoxycarbonyl groups, epoxy groups, cyano groups or halogen atoms) [for example, n-octyl, n-decyl, n-dodecyl, n-hexadecyl, 2-ethylhexyl, 1,3,5-trimethylhexyl, 3,5,5-trimethylhexyl, 2-ethyl-4-methylpentyl, 2-decyl, 2-hexyldecyl, 2-heptylundecyl, 2-octyldodecyl, 2,4,6-trimethylheptyl, 2,4,6,8-tetramethylnonyl, benzyl, 2-phenethyl, 3-(tertoctylphenyoxy)propyl, 3-(2,4-di-tert-pentylphenoxy)propyl, 2-(4-biphenyloxy)ethyl, 3-dodecyloxypropyl, 2-dodecylthioethyl, 9,10-epoxyoctadecyl, dodecyloxycarbonylmethyl, 2-(2-naphthyloxy)ethyl], an unsubstituted alkenyl group or an alkenyl group which has substituent groups (for example, halogen atoms, aryl groups, alkoxy groups, alkylthio groups, aryloxy groups, arylthio groups or alkoxycarbonyl groups) [for example, allyl, 10-undecenyl, oleyl, citronellyl, cinnamyl], an unsubstituted cycloalkyl group or a cycloalkyl group which has substituent groups (for example, halogen atoms, alkyl groups, alkoxy groups or aryloxy groups) [for example, cyclopentyl, cyclohexyl, 3,5-dimethylcyclohexyl, 4-tert-butylcyclohexyl], or an unsubstituted aryl group or aryl group which has substituent groups (for example, halogen atoms, alkyl groups, alkoxy groups, alkoxycarbonyl groups, aryl groups, carbonamido groups, alkylthio groups or sulfonamido groups) [for example, phenyl, 4-dodecyloxyphenyl, 4-biphenyl, 4-dodecanesulfonamidophenyl, 4-tert-octylphenyl, 3-pentadecylphenyl], and it is most preferably one of the above-described linear chain, branched chain or substituted alkyl groups.

In formula (I), $X^1$ represents a single bond, —O—, —S—, —SO—, —$SO_2$—, —COO—, $$-\underset{\underset{R^6}{|}}{CON}-,\quad -SO_2O-,\quad -\underset{\underset{R^6}{|}}{SO_2N}-\quad \text{or}\quad -\underset{\underset{R^7}{|}}{N}-.$$

Here, $R^6$ represents a hydrogen atom, an acyl group of C number from 1 to 36 (and preferably of C number from 2 to 24) (for example, acetamido, butanamido, benzamido, dodecanamido, methylsulfonyl, p-tolylsulfonyl, dodecylsulfonyl, 4-methoxyphenylsulfonyl) or a group with the same meaning as $R^1$, and it is preferably a hydrogen atom, a linear, branched or substituted alkyl group or a substituted or unsubstituted aryl group. $R^7$ is a hydrogen atom or a group with the same meaning as $R^1$, and it is preferably a hydrogen atom or a linear chain, branched chain or substituted alkyl group. The —COO—, $$-\underset{\underset{R^6}{|}}{CON}-,\quad -SO_2O-\quad \text{and}\quad -\underset{\underset{R^6}{|}}{SO_2N}-$$

in $X^1$ may be bonded to $R^1$ by either of the above bonds. $X^1$ is preferably —O—, —S—, —$SO_2$— or —COO— (bonded to $R^1$ through an O atom), and it is most preferably —O— or —COO— (bonded to $R^1$ through an O atom).

$R^2$ in formula (I) is a group which can be substituted on a benzene ring, and it is preferably a group selected from among the above-described group of A substituent groups, and when l is 2 or more the $R^2$ groups may be the same or different. $R^2$ is most preferably a halogen atom (F, Cl, Br, I), an alkyl group of C number from 1 to 24 (for example, methyl, butyl, tert-butyl, tert-octyl, 2-dodecyl), a cycloalkyl group of C number from 3 to 24 (for example, cyclopentyl, cyclohexyl), an alkoxy group of C number from 1 to 24 (for example, methoxy, butoxy, dodecyloxy, benzyloxy, 2-ethylhexyloxy, 3-dodecyloxypropoxy, 2-dodecylthioethoxy, dodecyloxycarbonylmethoxy), a carbonamido group of C number from 2 to 24 (for example, acetamido, 2-ethylhexanamido, trifluoroacetamido) or a sulfonamido group of C number from 1 to 24 (for example, methanesulfonamido), dodecanesulfonamido, toluenesulfonamido).

Moreover, l in formula (I) is preferably an integer of from 0 to 2, and most preferably it is 0 or 1.

$R^2$ in formula (II) is a group which can be substituted on a benzene ring, and it is preferably a group selected from the above-described group of A substituent groups, and when l is 2 or more the $R^2$ groups may be the same or different. $R^2$ is most preferably a halogen atom (F, Cl, Br, I), an alkyl group of C number from 1 to 24 (for example, methyl, n-butyl, sec-butyl, tert-butyl, tert-hexyl, tert-octyl, n-pentadecyl, iso-propyl, trifluoromethyl, benzyl, 2-dodecyl), a cycloalkyl group of C number from 3 to 24 (for example, cyclopentyl, cyclohexyl), an alkoxy group of C number from 1 to 24 (for example, methoxy, butoxy, dodecyloxy, benzyloxy, 2-ethoxyhexyloxy, 3-dodecyloxypropoxy, 2-dodecylthioethoxy, dodecyloxycarbonylmethoxy), a carbonamido group of C number from 2 to 24 (for example, acetamido, 2-ethylhexanamido, trifluoroacetamido), an alkylsulfonyl group of C number from 1 to 24 (for example, methylsulfonyl, butylsulfonyl, benzylsulfonyl), an arylsulfonyl group of C number from 6 to 24 [for example, phenylsulfonyl, p-tolylsulfonyl, 4-hydroxyphenylsulfonyl), an acyl group of C number from 1 to 24 (for example, acetyl, iso-butanoyl, benzoyl, dodecanoyl) a sulfonamido group or C number from 1 to 24 (for example, methanesulfonamido, dodecanesulfonamido, p-hydroxybenzenesulfonamido), a carbamoyl group of C number from 1 to 24 (for example, N-methylcarbamoyl, N-phenylcarbamoyl), a sulfamoyl group of C number from 0 to 24 (for example, N,N-diethylsulfamoyl, N-phenylsulfamoyl), an aryl group of C number from 6 to 24 (for example, phenyl, 4-methoxyphenyl, 1-naphthyl) or an alkoxycarbonyl group of C number from 2 to 24 (for example, methoxycarbonyl, butoxycarbonyl)

Moreover, l in formula (II) is preferably an integer of from 1 to 3, and

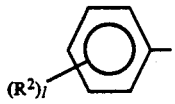

is preferably represented by formula (III) indicated below.

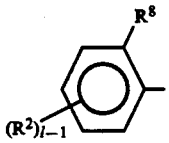

(III)

(wherein $R^8$ has the same meaning as $R^2$).

$R^8$ in formula (III) is preferably a halogen atom, a cyano group, a nitro group, a secondary, tertiary or substituted alkyl group, a cycloalkyl group, an aryl group, an acyl group, a carbonamido group, an alkylsulfonyl group, an arylsulfonyl group, an alkoxycarbonyl group, or a sulfonamido group.

$R^3$ in formula (I) and (II) preferably represents an aryl group of C number from 6 to 36, and most preferably from 6 to 15, and $R^3$ may be substituted with substituent groups selected from the group of A substituent groups, and it may be a condensed ring. Preferred substituent groups are halogen atoms (F, Cl, Br, I), cyano group, nitro group, acyl groups (for example, acetyl, benzoyl), alkyl groups (for example, methyl, tert-butyl, trifluoromethyl, trichloromethyl), alkoxy groups (for example, methoxy, ethoxy, butoxy, trifluoromethoxy), alkylsulfonyl groups (for example, methanesulfonyl, propylsulfonyl, butylsulfonyl, benzylsulfonyl), arylsulfonyl groups (for example, phehylsulfonyl, p-tolylsulfonyl, p-chlorophenylsulfonyl), alkoxycarbonyl groups (for example, methoxycarbonyl, butoxycarbonyl), sulfonamido groups (for example, methanesulfonamido, trifluoromethanesulfonamido, toluenesulfonamido), carbamoyl groups (for example, N,N-dimethylcarbamoyl, N-phenylcarbamoyl) or sulfamoyl groups (for example, N,N-diethylsulfamoyl, N-phenylsulfamoyl). $R^3$ is preferably a phenyl group which has at least one substituent group selected from halogen atoms, cyano group, sulfonamido groups, alkylsulfonyl groups, arylsulfonyl groups and trifluoromethyl group, more preferably $R^3$ is a 4-cyanophenyl, 4-cyano-3-halogenophenyl, 3-cyano-4-halogenophenyl, 4-alkylsulfonylphenyl, 4-alkylsulfonyl-3-halogenophenyl, 4-alkylsulfonyl-3-alkoxyphenyl, 3-alkoxy-4-alkylsulfonylphenyl, 3,4-dihalogenophenyl, 4-halogenophenyl, 3,4,5-trihalogenophenyl, 3,4-dicyanophenyl, 3-cyano-4,5-dihalogenophenyl, 4-trifluoromethylphenyl or 3-sulfonamidophenyl group, and most preferably $R^3$ is a 4-cyanophenyl, 3-cyanophenyl-4-halogenophenyl, 4-cyano-3-halogenophenyl, 3,4-dicyanophenyl or 4-alkylsulfonylphenyl group.

In formula (II), $R^4$ and $R^5$ each is preferably hydrogen atoms, alkyl groups of C number from 1 to 24, alkenyl groups of C number from 2 to 24, alkynyl groups of C number from 2 to 24, cycloalkyl groups of C number from 3 to 24, acyl groups of C number from 1 to 24, alkoxycarbonyl groups of C number from 2 to 24 or aryl groups of C number from 6 to 24, and the above-described groups other than the alkyl group may be substituted with substituent groups selected from the above-described group of A substituent groups (preferably halogen atoms, alkoxy groups, alkoxycarbonyl groups, aryl groups or aryloxy groups). $R^4$ and $R^5$ are most preferably hydrogen atoms, alkyl groups (for example, methyl, ethyl, iso-propyl, butyl, hexyl, octyl, decyl, dodecyl, hexadecyl, methoxymethyl, phenoxymethyl, benzyl) or aryl groups (for example, phenyl, 4-methoxyphenyl, p-tolyl, 1-naphthyl).

$Z^1$ in formulae (I) and (II) represents a hydrogen atom or a coupling-off group (including a leaving atom, hereinafter the same). Preferred examples of coupling-off groups include halogen atoms, $$-OR^9,\quad -SR^9,\quad -\underset{\underset{O}{\|}}{C}OR^9,\quad -OSO_2R^9,$$

$$-NHCOR^9,\quad -NH\underset{\underset{O}{\|}}{C}SR^9,\quad -O\underset{\underset{O}{\|}}{C}OR^9,\quad -O\underset{\underset{O}{\|}}{C}NHR^9,$$

arylazo groups of C number from 6 to 30, and heterocyclic groups (for example, succinimido, phthalimido, hydantoinyl, pyrazolyl, 2-benzotriazolyl) which are bonded to the coupling active site (the position to which $Z^1$ is bonded) by a nitrogen atom. Here, $R^9$ represents an alkyl group of C number from 1 to 36, an alkenyl group of C number from 2 to 36, a cycloalkyl group of C number from 3 to 36, an aryl group of C number from 6 to 36 or a heterocyclic group of C number from 2 to 36, and these groups may be substituted with substituent groups selected from the group of A substituent groups. $Z^1$ is more preferably a hydrogen atom, a halogen atom, an alkoxy group, an aryloxy group or an alkylthio group, and $Z^1$ is most preferably a hydrogen atom, a chlorine atom, a group represented by the formula (IV) shown below or a group represented by the formula (V) shown below.

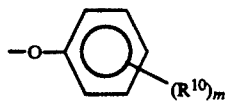

(IV)

In the formula (IV), $R^{10}$ represents a halogen atom, a cyano group, a nitro group, an alkyl group, an alkoxy group, an alkylthio group, an alkylsulfonyl group, an arylsulfonyl group, a carbonamido group, a sulfonamido group, an alkoxycarbonyl group, a carbamoyl group, a sulfamoyl group or a carboxyl group, and m represents an integer of from 0 to 5. Here, when m is 2 or more the $R^{10}$ groups may be the same or different.

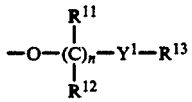

(V)

In the formula (V), $R^{11}$ and $R^{12}$ each represents a hydrogen atom or a univalent group, $Y^1$ represents

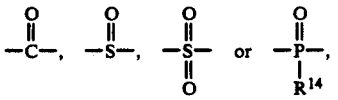

$R^{13}$ and $R^{14}$ each represent a hydroxyl group, an alkyl group, an aryl group, an alkoxy group, an alkenyloxy group, an aryloxy group or a substituted or unsubstituted amino group, and n represents an integer of from 1 to 6. Here, when n is 2 or more the

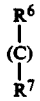

groups may be the same or different.

In formula (IV), $R^{10}$ is preferably a halogen atom, an alkyl group (for example, methyl, tert-butyl, tert-octyl, pentadecyl), an alkoxy group (for example, methoxy, n-butoxy, n-octyloxy, benzyloxy, methoxyethoxy), a carbonamido group (for example, acetamido, 3-carboxypropanamido) or a sulfonamido group (for example, methanesulfonamido, toluenesulfonamido, p-dodecyloxybenzenesulfonamido), and $R^{10}$ is most preferably an alkyl group or an alkoxy group. Moreover, m is preferably an integer of from 0 to 2, and preferably 0 or 1.

When $R^{11}$ and/or $R^{12}$ in formula (V) is a univalent group, the univalent group is preferably an alkyl group (for example, methyl, ethyl, n-butyl, ethoxycarbonylmethyl, benzyl, n-decyl, n-dodecyl), an aryl group (for example, phenyl, 4-chlorophenyl, 4-methoxyphenyl) and acyl group (for example, acetyl, decanoyl, benzoyl, pivaloyl) or a carbamoyl group (for example, N-ethylcarbamoyl, N-phenylcarbamoyl), and $R^{11}$ and $R^{12}$ are most preferably hydrogen atoms, alkyl groups or aryl groups.

Moreover, $Y^1$ in formula (V) is preferably

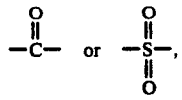

and most preferably $Y^1$ is

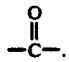

$R^{13}$ in formula (V) is preferably an alkyl group, an alkoxy group, an alkenyloxy group, an aryloxy group or a substituted or unsubstituted amino group, and $R^{13}$ is most preferably an alkoxy group or a substituted or unsubstituted amino group.

Moreover, n in formula (V) is preferably an integer of from 1 to 3, and n is most desirably 1.

When $Z^1$ in formulae (I) and (II) is a coupling-off group, it is preferred that $Z^1$ does not contain a photographically useful group (for example, a development inhibitor residue or a dye residue).

When l in formula (I) or (II) is 2 or more, the two $R^2$ groups may combine (for example, —$OCH_2O$—, —$OCH_2CH_2O$—, —CH=CHO—, —CH=CHS—, —CH=CH—CH=CH—) and form a condensed ring with the benzene ring.

Specific examples of

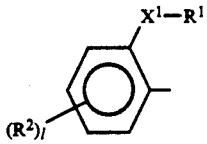

in formula (I) are shown below.

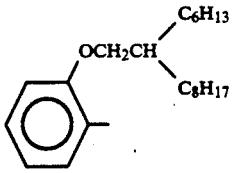

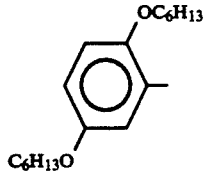

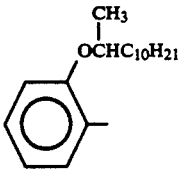

-continued
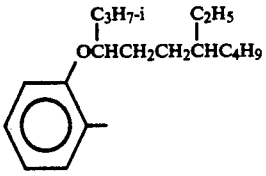
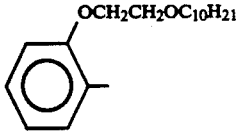
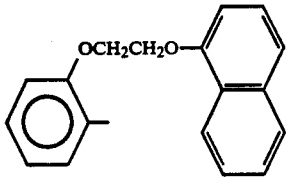
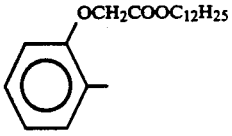
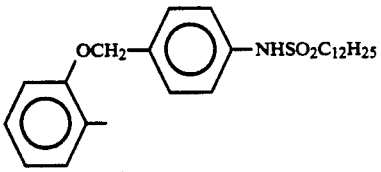
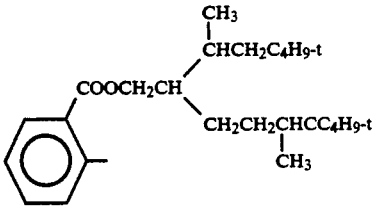
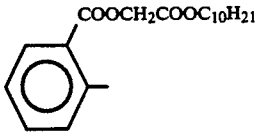
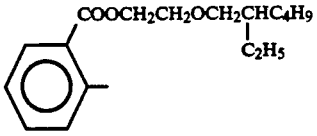
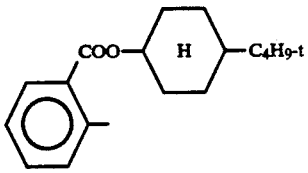
-continued
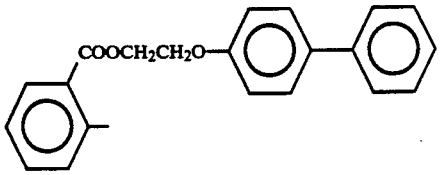
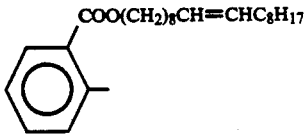
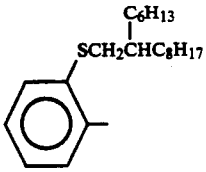
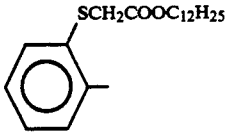
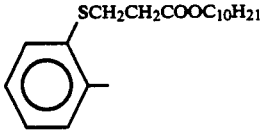
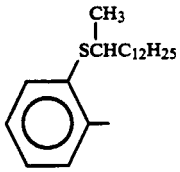
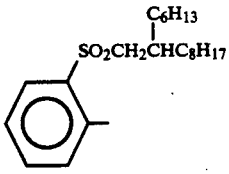
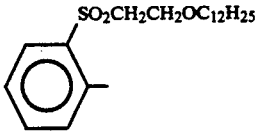
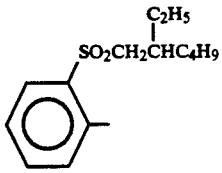

-continued
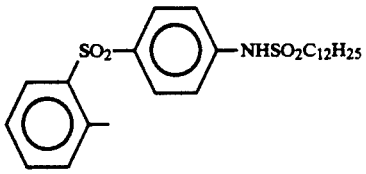
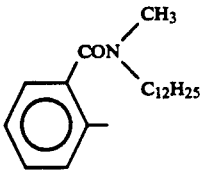
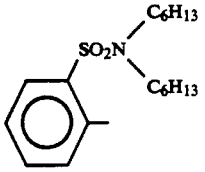
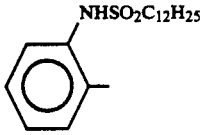
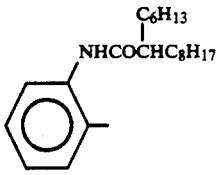
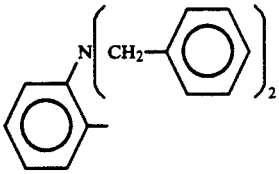
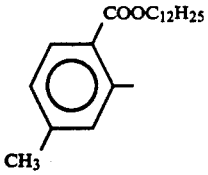
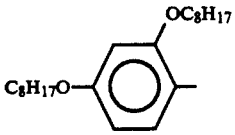
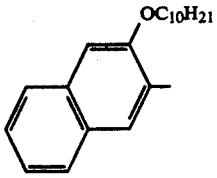
Specific examples of
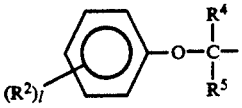
in formula (II) are shown below.
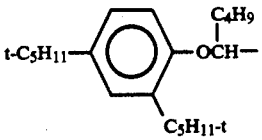
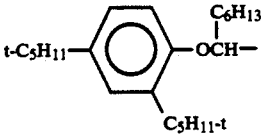
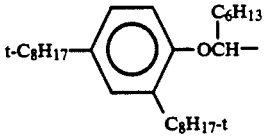
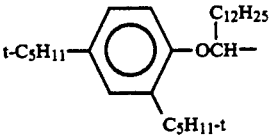
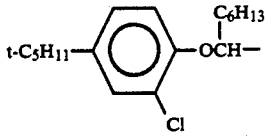
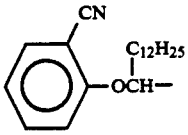
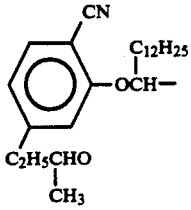
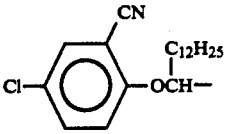
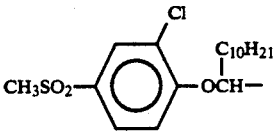

-continued
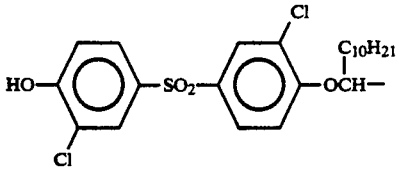
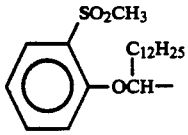
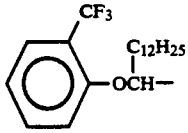
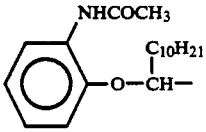
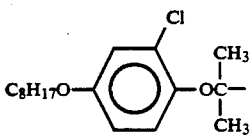
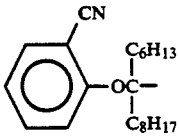
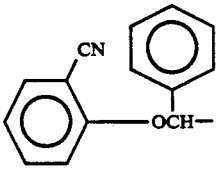
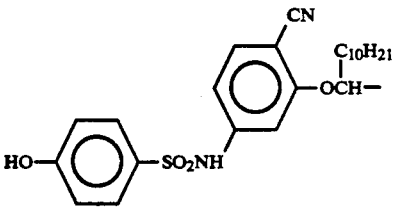
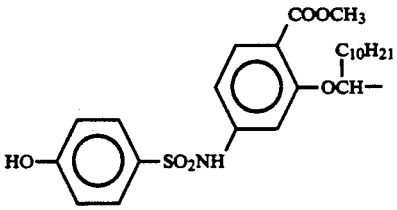
-continued
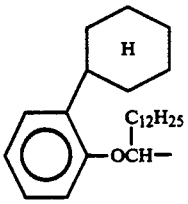
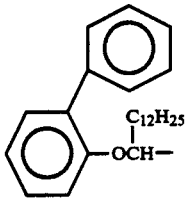
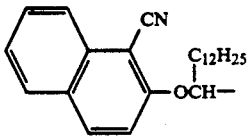
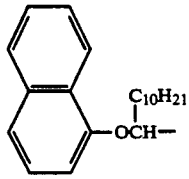
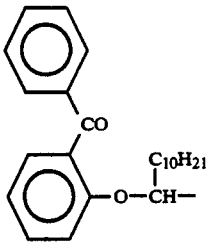
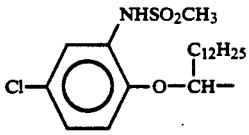
Examples of $R^3$ in formulae (I) and (II) are shown below.
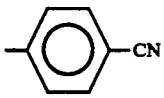
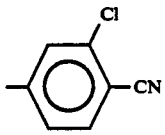

-continued
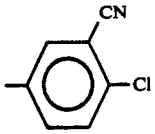
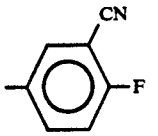
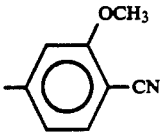
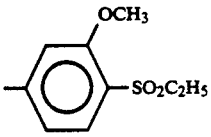
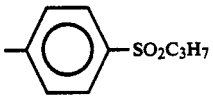
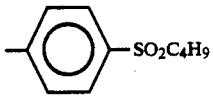
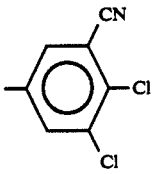
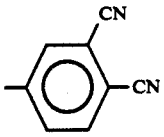
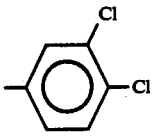
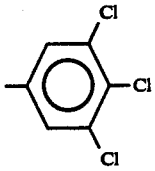
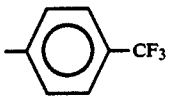
-continued
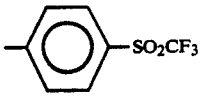
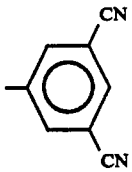
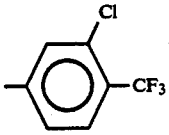
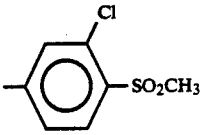
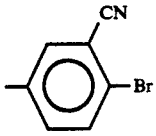
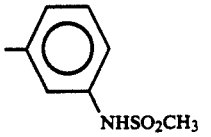
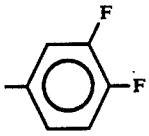
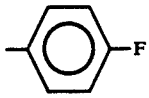
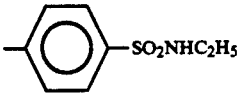
Examples of $Z^1$ in formulae (I) and (II) are shown below.
H F Cl -continued $-OC(=O)CH_3$ $-OSO_2CH_3$ $-OC(=O)OC_2H_5$ $-OC(=O)NHC_2H_5$

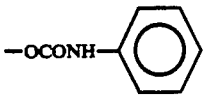

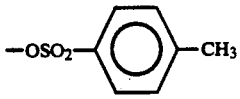

$-OCH_3$ $-OC_2H_5$ $-OCH_2CH_2OCH_3$ $-OCH_2COOCH_3$ $-OCH_2CH_2COOCH_3$ $-OCH(CH_3)COOCH_3$ $-OCH_2COOH$ $-OCH_2CH_2SO_2CH_3$ $-OCH_2CONHCH_2CH_2OH$ $-OCH_2CONHCH_2CH_2OCH_3$ $-OCH_2CH{=}CH_2$ $-OCH_2CH_2N(CH_3)_2$ $-OCH_2CH_2P(=O)(OC_2H_5)_2$ $-OCH_2P(=O)(OCH_3)_2$ $-OCH(CH_2COOC_2H_5)COOC_2H_5$ $-OCH_2CH_2OH$ $-OCH_2CH_2SCH_2COOH$ $-OCH_2CH_2NHSO_2CH_3$

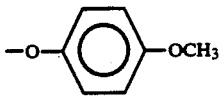

-continued

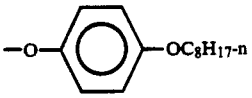

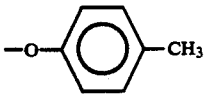

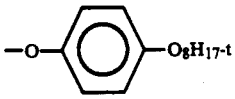

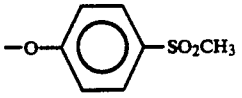

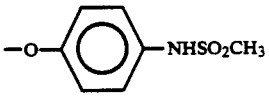

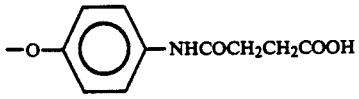

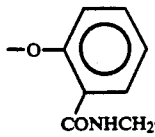

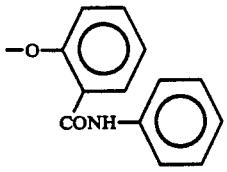

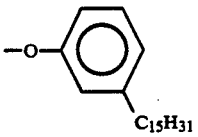

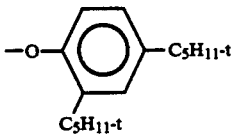

$-SCH_2COOC_2H_5$ $-SCH_2COOH$ $-SCH_2CH_2COOH$ $-SCH(CH_3)COOH$ $-SCH_2CH_2OH$

-continued
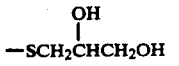
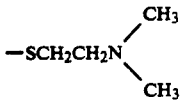
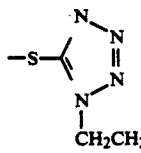
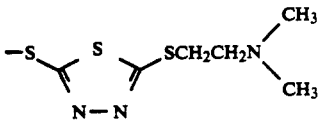
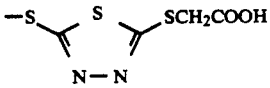
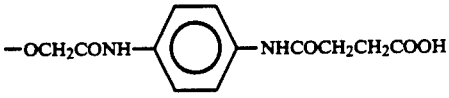
-continued
$-OCH_2COOC_4H_{9}$-sec
$-OCH_2COOC_4H_{9}$-t
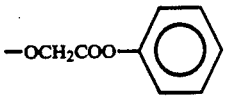
$-OCH_2COOCH_2CH_2OCH_3$
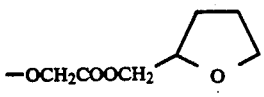
$-OCH_2COOCH_2COOC_2H_5$
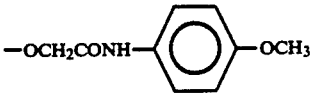
$-OCH_2COOCH_2CH_2SO_2CH_3$
Specific examples of cyan dye forming couplers represented by formula (I) are shown below but the present invention is not to be construed as being limited to these examples.
(I)
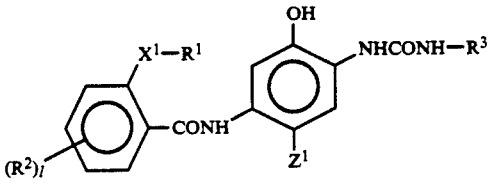
| Number | 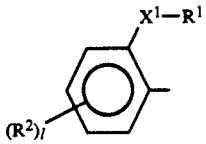 | $R^3$ | $Z^1$ |
|---|---|---|---|
| I-1 | 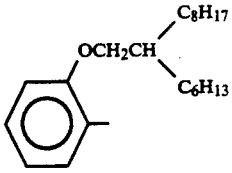 | 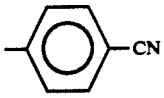 | H |
| I-2 | 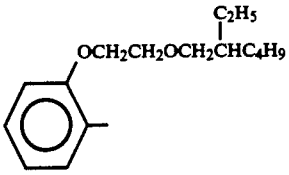 | 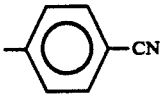 | H |
| I-3 | 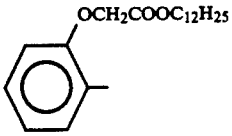 | 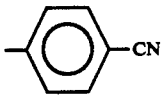 | H |

-continued
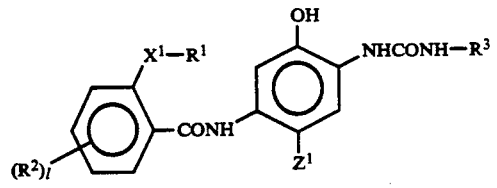
(I)
| Number | 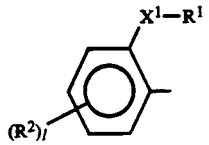 | $R^3$ | $Z^1$ |
|---|---|---|---|
| I-4 | 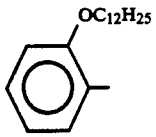 | 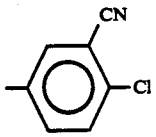 | H |
| I-5 | 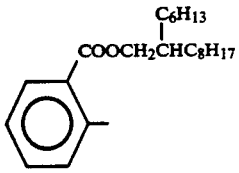 | 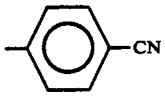 | H |
| I-6 | 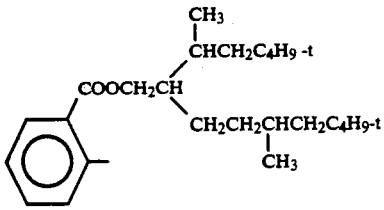 | 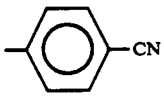 | H |
| I-7 | 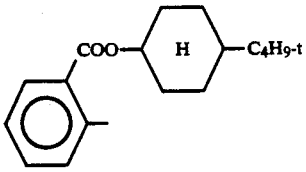 | 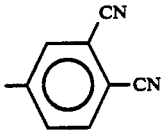 | H |
| I-8 | 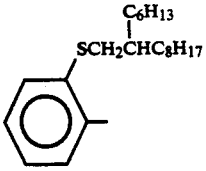 | 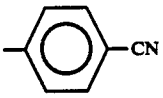 | H |
| I-9 | 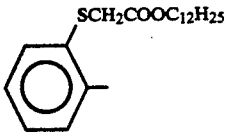 | 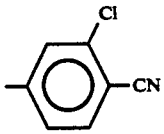 | H |
| I-10 | 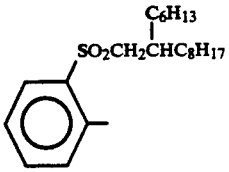 | 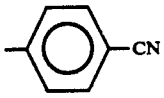 | H |

-continued
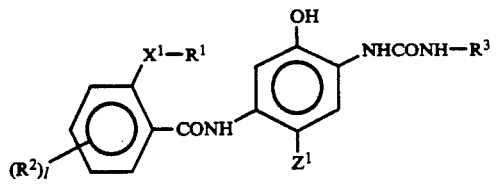
(I)
| Number | 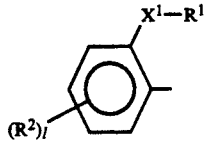 | $R^3$ | $Z^1$ |
|---|---|---|---|
| I-11 | 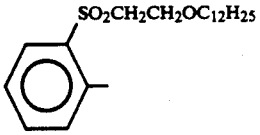 | 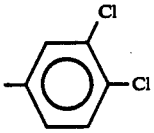 | H |
| I-12 | 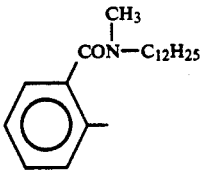 | 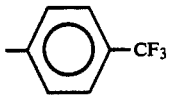 | H |
| I-13 | 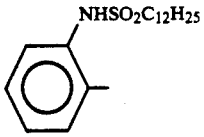 | 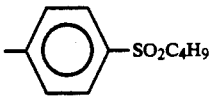 | H |
| I-14 | 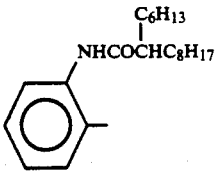 | 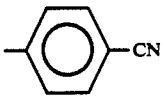 | Cl |
| I-15 | 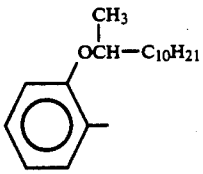 | 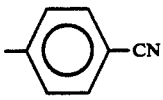 | Cl |
| I-16 | 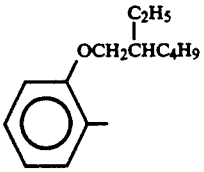 | 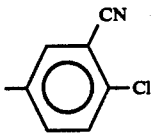 | $-OCH_2COOCH_3$ |
| I-17 | 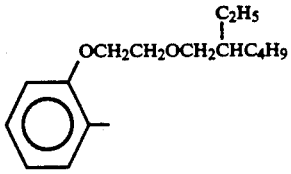 | 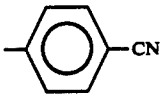 | 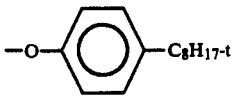 |

-continued (I)

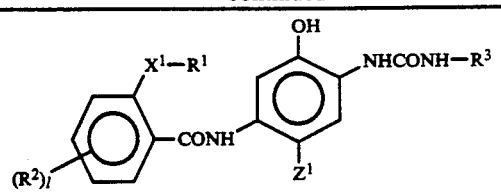

| Number | $(R^2)_l$ | $R^3$ | $Z^1$ |
|---|---|---|---|
| I-18 | $COOCH_2CHC_4H_9$ ($C_2H_5$) | CN | —O— OCH$_3$ |
| I-19 | $OC_8H_{17}$; $C_8H_{17}O$ | CN | —SCH$_2$COOH |
| I-20 | $OC_6H_{13}$; $C_6H_{13}O$ | Cl; CN | —SCH$_2$CH$_2$N(CH$_3$)$_2$ |

Specific examples of cyan dye forming couplers represented by formula (II) are shown below but the present invention is not to be construed as being limited to these examples.

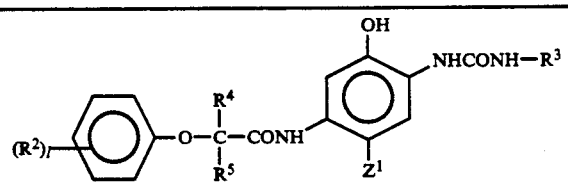

| Number | $(R^2)_l$ | $R^3$ | $Z^1$ |
|---|---|---|---|
| II-1 | t-$C_5H_{11}$; $C_4H_9$; $C_5H_{11}$-t | CN | H |
| II-2 | t-$C_5H_{11}$; $C_6H_{13}$; $C_5H_{11}$-t | CN | H |

-continued
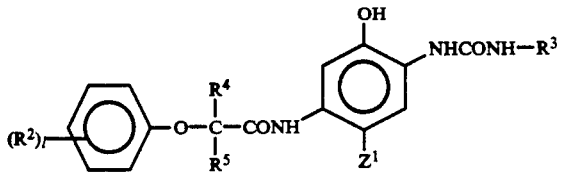
| Number | $(R^2)_l$ | $R^3$ | $Z^1$ |
|---|---|---|---|
| II-3 | 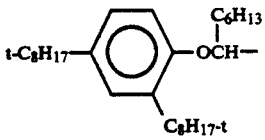 | 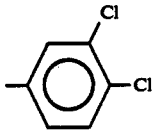 | H |
| II-4 | 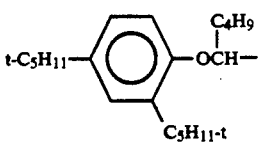 | 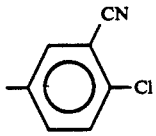 | H |
| II-5 | 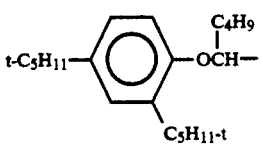 | 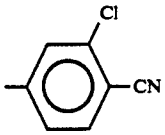 | H |
| II-6 | 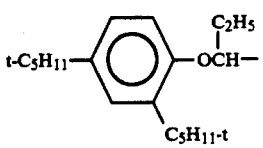 | 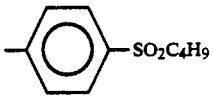 | H |
| II-7 | 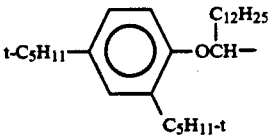 | 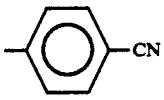 | Cl |
| II-8 | 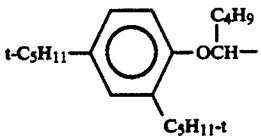 | 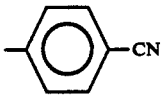 | 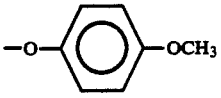 |
| II-9 | 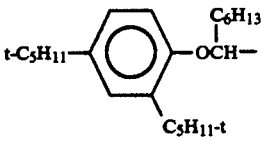 | 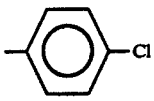 | 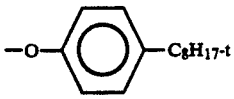 |
| II-10 | 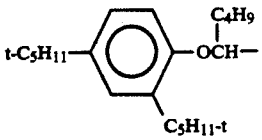 | 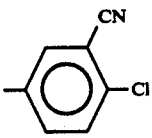 | $-OCH_2COOCH_3$ |

-continued
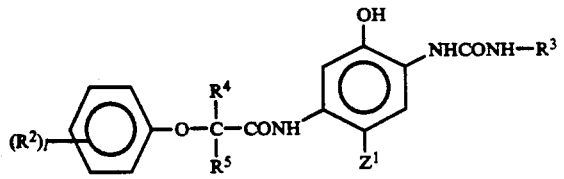
| Number | 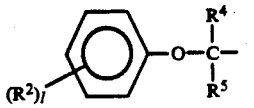 | $R^3$ | $Z^1$ |
|---|---|---|---|
| II-11 | 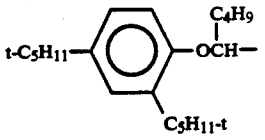 | 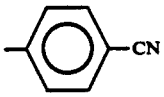 | —$SCH_2COOH$ |
| I-12 | 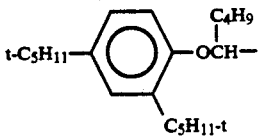 | 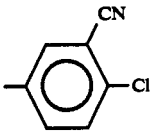 | —$SCH_2CH_2N(CH_3)_2$ |
| II-13 | 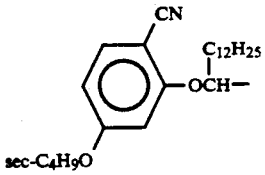 | 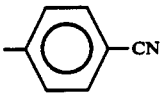 | H |
| II-14 | 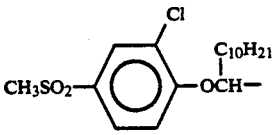 | 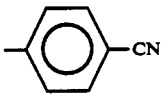 | H |
| II-15 | 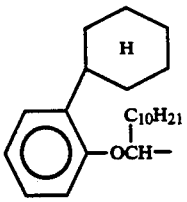 | 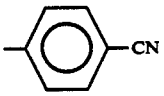 | H |
| II-16 | 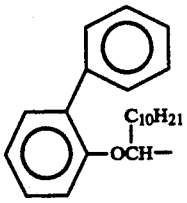 | 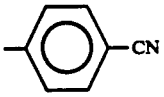 | H |
| II-17 | 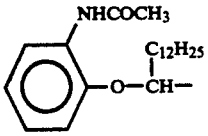 | 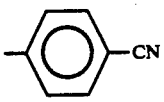 | H |

-continued

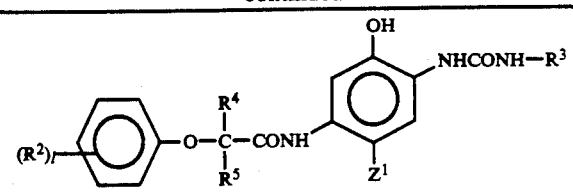

| Number | | $R^3$ | $Z^1$ |
|---|---|---|---|
| II-18 | 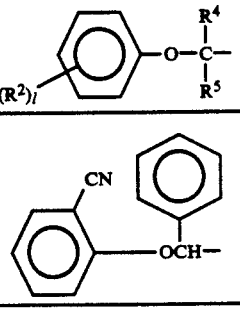 | 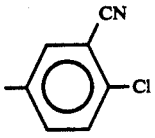 | H |

A typical route for the synthesis of cyan dye forming couplers of the present invention represented by formula (I) is indicated schematically below.

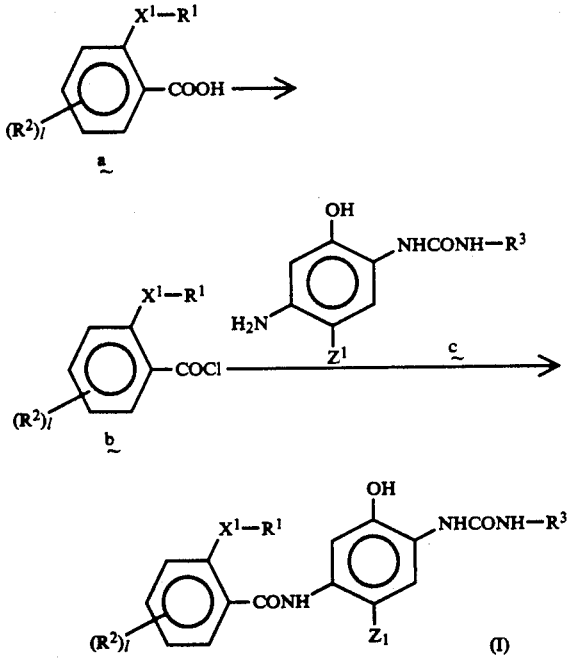

Compound a can be produced easily using known methods from salicylic acids, thiosalicylic acids, phthalic acid anhydrides or anthranilic acids, for example.

The production of b from a is achieved by reacting with thionyl chloride, phosphorus oxychloride, phosphorus pentachloride, oxalyl chloride etc. in the absence of a solvent or in the presence of a solvent such as methylene chloride, chloroform, carbon tetrachloride, dichloroethane, toluene, N,N-dimethylformamide or N,N-dimethylacetamide, for example. The reaction temperature is generally from −20° C. to 150° C., and preferably from −10° C. to 80° C.

Compound c can be prepared using the synthesis methods described, for example, in U.S. Patent 4,333,999, JP-A-60-35731, JP-A-61-2757, JP-A-61-42658 and JP-A-63-208562.

The reaction of b and c can be carried out in the absence of a solvent or in the presence of a solvent such as acetonitrile, ethyl acetate, tetrahydrofuran, dioxane, N,N-dimethylformamide, N,N-dimethylacetamide, N,N'-dimethylimidazolin-2-one, for example, generally at a temperature of from −20° C. to 150° C. and preferably of from −10° C. to 80° C. A weak base, such as pyridine, imidazole, N,N-dimethylaniline, for example, can be used. The cyan couplers represented by formula (I) can also be prepared by direct dehydration/condensation of a and c, and in this case N,N'-dichlorohexylcarbodiimide or carbonyldiimidazole, for example, can be used as a condensing agent.

SYNTHESIS EXAMPLE

Preparation of Illustrative Coupler I-5

2-Hexyldodecanol (24.2 grams) and 7.9 grams of pyridine were dissolved in 100 ml of ethyl acetate and 14.8 grams of phthalic acid anhydride were added at room temperature (about 20°-30° C.) with stirring. After stirring the mixture for 3 hours at 50° C., the reaction mixture was transferred to a separation funnel, washed twice with dilute hydrochloric acid (1N) and concentrated.

The concentrate was dissolved in 50 ml of methylene chloride, 0.3 ml of N,N-dimethylformamide was added and 13 grams of oxalyl chloride was added dropwise over a period of about 30 minutes at room temperature with stirring. After stirring for about 1 hour, the mixture was concentrated and 2-dodecyloxycarbonylbenzoyl chloride was obtained in the form of an oil.

5-Amino-2-[3-(4-cyanophenyl)ureido]phenol (24.2 grams) prepared using the method of synthesis described in U.S. Pat. No. 4,333,999 was dissolved in 200 ml of N,N-dimethylacetamide and 2-dodecyloxycarbonylbenzoyl chloride was added dropwise over a period of about 30 minutes at room temperature with stirring. After the addition, the mixture was stirred for 2 hours and then the reaction mixture was transferred to a separation funnel. Ethyl acetate (500 ml) was added and the mixture was washed twice with dilute hydrochloric acid (1N) and then with a saturated aqueous solution of sodium bicarbonate, after which it was dried over sodium sulfite. The ethyl acetate solution was concentrated to about half the original volume and the crystals which precipitated out were recovered by filtration. On drying, 36.9 grams of Coupler I-5 was obtained. The melting point of this compound was 185° C. to 189° C. and the structure was confirmed using $^1H$ NMR spectroscopy, mass spectrometry and elemental analysis.

Cyan dye forming couplers represented by formula (II) can be prepared using the methods described, for example, in U.S. Pat. No. 4,333,999, European Patent (EP) 271323A, JP-A-60-24547, JP-A-60-55340, JP-A-61-2757 and JP-A-63-208562.

The total amount of cyan coupler represented by formula (I) and cyan coupler represented by formula (II) used in the present invention is generally from 0.002 to 1 mol, and preferably from 0.01 to 0.3 mol, per mol of photosensitive silver halide. Furthermore, the total coated weight per square meter of photosensitive material is from 0.01 to 5 mmol, and preferably from 0.1 to 2 mmol.

The cyan coupler represented by formula (I) can be used individually in the present invention, or two or more of these cyan couplers may be used in combination. Similarly, the cyan couplers represented by formula (II) can be used individually, or two or more of these couplers can be used in combination.

The proportions of the cyan couplers represented by formulae (I) and (II) in the present invention are such that the total amount of cyan coupler represented by formula (I) is at least 20 wt %, preferably at least 50 wt %, and more preferably at least 90 wt % with respect to the total amount of cyan coupler represented by formula (I) and formula (II) which is used.

The cyan couplers of the present invention can be used in any photosensitive emulsion layer, non-photosensitive emulsion layer or intermediate layer, but they are preferably added to and used in a photosensitive emulsion layer, and most desirably they are added to and used in the red sensitive silver halide emulsion layer.

Various known methods of dispersion can be employed to introduce lipophilic photographically useful organic compounds, such as the cyan couplers of the present invention, into a photosensitive material. Thus, the lipophilic photographically useful organic compounds can be dissolved in a high boiling point organic solvent having a boiling point at normal pressure of at least about 175° C., for example, phthalic acid esters, phosphoric acid esters, benzoic acid esters, fatty acid esters, amides, phenols, alcohols, carboxylic acids, N,N-dialkylanilines, hydrocarbons, oligomers or polymers and/or low boiling point organic solvents having a boiling point at normal pressure from about 30° C. to about 160° C. such as esters (for example, ethyl acetate, butyl acetate, ethyl propionate, β-ethoxyethyl acetate, methyl Cellosolve acetate), alcohols (for example, sec-butyl alcohol), ketones (for example, methyl iso-butyl ketone, methyl ethyl ketone, cyclohexanone), amides (for example, dimethylformamide, N-methylpyrrolidone) and ethers (for example, tetrahydrofuran, dioxane), and the solution can then be emulsified and dispersed in a hydrophilic colloid using the oil in water dispersion method disclosed, for example, in U.S. Pat. No. 2,322,027.

The processes and effects of the latex dispersion method and actual examples of latexes for loading purposes are disclosed, for example, in U.S. Pat. No. 4,199,363, West German Patent Applications (OLS) 2,541,274 and 2,541,230 and European Patent 294104A. These high boiling point organic solvents and latexes function not only as simple dispersion media but also have various other functions such as to improve the physical properties of the gelatin film, to accelerate color formation, to adjust the hue of the colored image which is formed and to improve the fastness of the colored image for example, depending on the structure selected. The high boiling point organic solvents may have any form, for example they may be liquids, waxes or solids, and they are preferably represented by the formulae (S-1) to (S-9) indicated below.

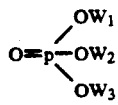
(S-1)

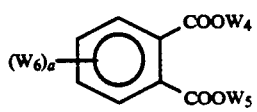
(S-2)

$(Ar—COO)_b W_7$ (S-3)

$(W_8—COO)_c W_9$ (S-4)

$W_{10}(COO—W_{11})_d$ (S-5)

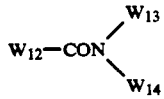
(S-6)

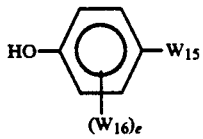
(S-7)

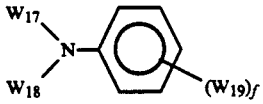
(S-8)

$—(A_1)_{a1}—(A_2)_{a2}—\cdots—(A_1)_{an}—$ (S-9)

In formula (S-1), $W_1$, $W_2$ and $W_3$ each independently represents an alkyl group, a cycloalkyl group or an aryl group.

In formula (S-2), $W_4$ and $W_5$ each independently represents an alkyl group, a cycloalkyl group or an aryl group, $W_6$ represents a halogen atom (F, Cl, Br, I, same below), an alkyl group, an alkoxy group, an aryloxy group or an alkoxycarbonyl group, and a represents an integer of from 0 to 3. When a is 2 or 3, the $W_6$ groups may be the same or different.

Ar in formula (S-3) represents an aryl group, b represents an integer from 1 to 6, and $W_7$ represents a b-valent hydrocarbyl group or hydrocarbyl groups which are joined together by an ether bond.

$W_8$ in formula (S-4) represents an alkyl group or a cycloalkyl group, and c represents an integer of value from 1 to 6, and $W_9$ represents a c-valent hydrocarbyl group or hydrocarbyl groups which are joined together with an ether bond.

In formula (S-5), d represents an integer of from 2 to 6, and $W_{10}$ represents a d-valent hydrocarbyl group (excluding aromatic groups) and $W_{11}$ represents an alkyl group, a cycloalkyl group or an aryl group.

$W_{12}$, $W_{13}$ and $W_{14}$ in formula (S-6) each independently represents an alkyl group, a cycloalkyl group or an aryl group. $W_{12}$ and $W_{13}$, or $W_{13}$ and $W_{14}$, may combine and form a ring.

$W_{15}$ in formula (S-7) represents an alkyl group, a cycloalkyl group, an alkoxycarbonyl group, an alkylsulfonyl group, an arylsulfonyl group, an aryl group or a cyano group, $W_{16}$ represents a halogen atom, an alkyl group, a cycloalkyl group, an aryl group, an alkoxy group or an aryloxy group, and e represents an integer of value from 0 to 3. When e is 2 or 3, the $W_{16}$ groups may be the same or different.

In formula (S-8), $W_{17}$ and $W_{18}$ each independently represents an alkyl group, a cycloalkyl group or an aryl group, $W_{19}$ represents a halogen atom, a cycloalkyl group, an alkyl group, an aryl group, an alkoxy group or an aryloxy group, and f represents an integer of value from 0 and 4. When f is 2, 3 or 4, the $W_{19}$ groups may be the same or different.

In formula (S-9), $A_1$, $A_2$ . . . $A_n$ represent polymer units derived from different non-color forming ethylenic monomers, and $a_1$, $a_2$ . . . $a_n$ represent the proportions by weight of these polymer units, and n represent an integer of from 1 to 30.

Specific examples of high boiling point organic solvents which can be used in the present invention are shown below.

S-1

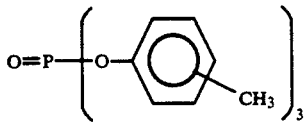

S-2

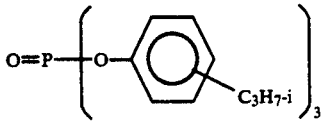

S-3

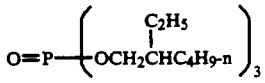

S-4

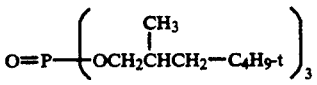

S-5

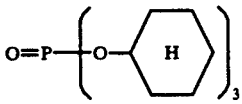

S-6

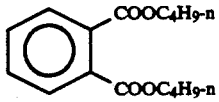

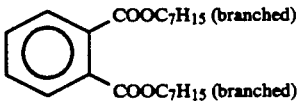

-continued

S-8

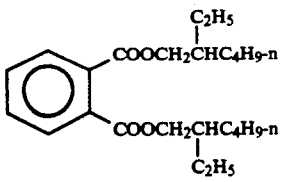

S-9

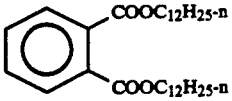

S-10

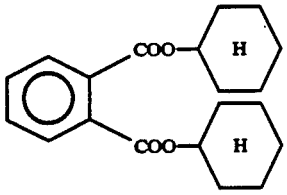

S-11

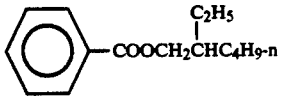

S-12

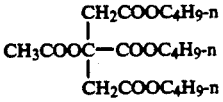

S-13

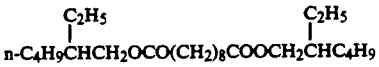

S-14

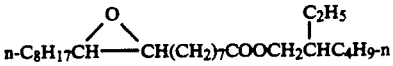

S-15

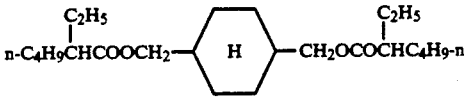

S-16

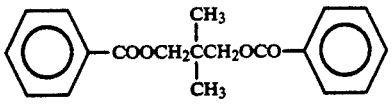

S-17

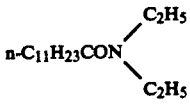

S-18

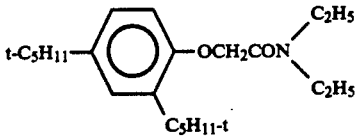

S-19

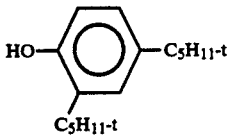

-continued

S-20

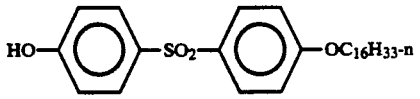

S-21

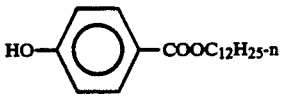

S-22

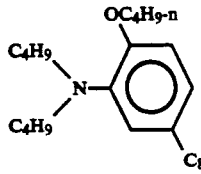

S-23

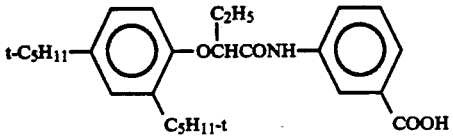

S-24 Poly(methyl methacrylate)
(Average molecular weight 20,000)

S-25 Poly(N-tert-butylacrylamide)
(Average molecular weight 60,000)

S-26 Chlorinated paraffin
(Average composition $C_{12}H_{18}Cl_8$)

Examples of compounds other than the above-described high boiling point organic solvents which can be used in the present invention and/or methods for the preparation of these high boiling point organic solvents are disclosed, for example, in U.S. Pat. Nos. 2,322,027, 2,533,514, 2,772,163, 2,835,579, 3,676,137, 3,912,515, 3,936,303, 4,080,209, 4,127,413, 4,193,802, 4,239,851, 4,278,757, 4,363,873, 4,483,918 and 4,745,049, European Patent 276319A, JP-A-48-47335, JP-A-51-149028, JP-A-61-84641, JP-A-62-228345, JP-A-62-247364, JP-A-63-167357, JP-A-64-68745 and JP-A-1-101543.

Carboxylic acid amides, phosphoric acid esters, phthalic acid esters, benzoic acid esters, fatty acid esters or chlorinated paraffins are preferred for the high boiling point organic solvent used in the present invention, and these can be represented by the above-described formulae (S-1), (S-2), (S-3), (S-4), (S-5) and (S-6). These high boiling point organic solvents are described in detail below.

When, in formulae (S-1) to (S-6), $W_1$ to $W_6$, $W_8$ and $W_{11}$ to $W_{14}$ are alkyl groups or groups which contain alkyl groups, the alkyl groups may be either linear chain or branched chain alkyl groups and they may contain unsaturated bonds and they may have substituent groups. Examples of suitable substituent groups include halogen atoms, aryl groups, alkoxy groups, aryloxy groups, alkoxycarbonyl groups, hydroxyl groups, acyloxy groups and epoxy groups.

When, in formulae (S-1) to (S-6), $W_1$ to $W_6$, $W_8$ and $W_{11}$ to $W_{14}$ are cycloalkyl groups or groups which contain cycloalkyl groups, the cycloalkyl groups may contain unsaturated groups in a three to eight membered ring and they may have substituent groups and crosslinking groups. Examples of suitable substituent groups include halogen atoms, hydroxyl groups, acyl groups, aryl groups, alkoxy groups, epoxy groups and alkyl groups, and examples of crosslinking groups include methylene, ethylene and isopropylidene.

When, in formulae (S-1) to (S-6), $W_1$ to $W_6$, $W_8$ and $W_{11}$ to $W_{14}$ are aryl groups or groups which contain aryl groups, the aryl groups may be substituted, for example, with halogen atoms, alkyl groups, aryl groups, alkoxy groups, aryloxy groups or alkoxycarbonyl groups.

When, in formulae (S-3), (S-4) and (S-5), $W_7$, $W_9$ and $W_{10}$ are hydrocarbyl groups, the hydrocarbyl groups may have a ring structure (for example, a benzene ring, a cyclopentyl ring, a cyclohexyl ring) and they may contain unsaturated bonds and they may also have substituent groups. Examples of suitable substituent groups include halogen atoms, hydroxyl groups, acyloxy groups, aryl groups, alkoxy groups, aryloxy groups and epoxy groups.

The most preferred high boiling point organic solvents used in the present invention are described below.

In formula (S-1), $W_1$, $W_2$ and $W_3$ are alkyl groups in which the total number of carbon atoms (also referred to hereinafter as the C number) is from 1 to 24 (and preferably from 4 to 18) (for example, n-butyl, 2-ethylhexyl, 3,5,5-trimethylhexyl, n-dodecyl, n-octadecyl, benzyl, oleyl, 2-chloroethyl, 2,3-dichloropropyl, 2-butoxyethyl, 2-phenoxyethyl), cycloalkyl groups of C number from 5 to 24 (and preferably from 6 to 18) (for example, cyclopentyl, cyclohexyl, 4-tertbutylcyclohexyl, 4-methylcyclohexyl) or aryl groups of C number from 6 to 24 (and preferably from 6 to 18) (for example, phenyl, cresyl, p-nonylphenyl, xylyl, cumenyl, p-methoxyphenyl, p-methoxycarbonylphenyl). $W_1$, $W_2$ and $W_3$ are most preferably alkyl groups or cycloalkyl groups.

In formula (S-2), $W_4$ and $W_5$ are alkyl groups of C number from 1 to 24 (and preferably from 4 to 18) (for example, the above-described alkyl groups described in connection with $W_1$, ethoxycarbonylmethyl, 1,1-diethylpropyl, 2-ethyl-1-methylhexyl, cyclohexylmethyl, 1-methyl-1,5-dimethylhexyl), cycloalkyl groups of C number from 5 to 24 (and preferably from 6 to 18) for example, the above-described cycloalkyl groups described in connection with $W_1$, 3,5,5-trimethylcyclohexyl, menthyl, bornyl, 1-methylcyclohexyl) or aryl groups of C number from 6 to 24 (and preferably from 6 to 18) (for example, the above-described aryl groups described in connection with $W_1$, 4-tert-butylphenyl, 4-tert-octylphenyl, 1,3,5-trimethylphenyl, 2,4-di-tert-butylphenyl, 2,4-di-tert-pentylphenyl), and $W_6$ is a halogen atom (preferably Cl), an alkyl group of C number from 1 to 18 (for example, methyl, iso-propyl, tert-butyl, n-dodecyl) an alkoxy group of C number from 1 to 18 (for example methoxy, n-butoxy, n-octyloxy, methoxyethoxy, benzyloxy), an aryloxy group of C number from 6 to 18 (for example, phenoxy, p-tolyloxy, 4-methoxyphenoxy, 4-tertbutylphenoxy) or an alkoxycarbonyl group of C number from 2 to 19 (for example, methoxycarbonyl, n-butoxycarbonyl, 2-ethylhexyloxycarbonyl), and a is 0 or 1.

In formula (S-3), Ar is an aryl group of C number from 6 to 24 (and preferably from 6 to 18) (for example, phenyl, 4-chlorophenyl, 4-methoxyphenyl, 1-naphthyl, 2-naphthyl, 4-n-butoxyphenyl, 1,3,5-trimethylphenyl), b is an integer from 1 to 4 (and preferably from 1 to 3), and $W_7$ is a b-valent hydrocarbyl group of C number from 2 to 24 (and preferably from 2 to 18) [for example the above-described alkyl groups, cycloalkyl groups and aryl groups described for $W_4$, $-(CH_2)_2-$,

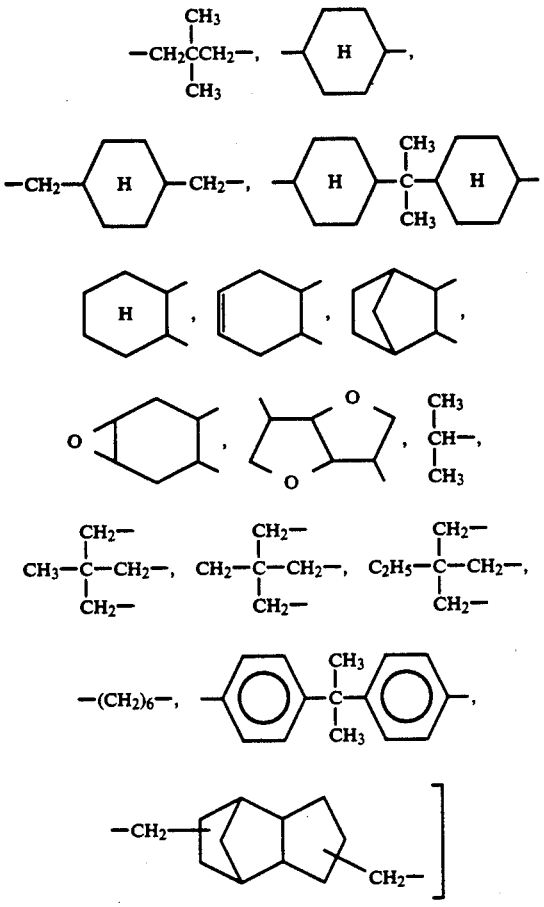

or b-valent hydrocarbyl groups of C number from 4 to 24 (and preferably from 4 to 18) which are bonded together with ether bonds [for example $-CH_2CH_2OCH_2CH_2-$, $-CH_2CH_2(OCH_2CH_2)_3-$, $-CH_2CH_2CH_2OCH_2CH_2CH_2-$,

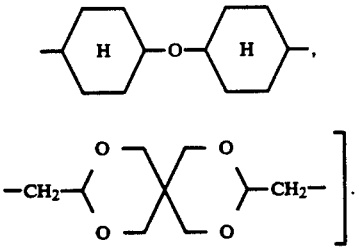

In formula (S-4), $W_8$ is an alkyl group of C number from 1 to 24 (and preferably from 1 to 17) (for example, methyl, n-propyl, 1-hydroxyethyl, 1-ethylpentyl, n-undecyl, pentadecyl, 8,9-epoxyheptadecyl) or a cycloalkyl group of C number from 3 to 34 (and preferably of from 6 to 18) (for example, cyclopropyl, cyclohexyl, 4-methylcyclohexyl), c is an integer from 1 to 4 (and preferably from 1 to 3), and $W_9$ is a c-valent hydrocarbyl group of carbon number from 2 to 24 (and preferably from 2 to 18) or a c-valent hydrocarbyl group of C number from 4 to 24 (and preferably from 4 to 18 in which the hydrocarbyl groups are joined together by ether bonds (for example, the above-described groups described for $W_7$).

In formula (S-5), d is from 2 to 4 (and preferably 2 or 3), $W_{10}$ is a d-valent hydrocarbyl group [for example, $-CH_2-$, $-(CH_2)_2-$, $-(CH_2)_4-$, $-(CH_2)_7-$, $-(CH_2)_8-$,

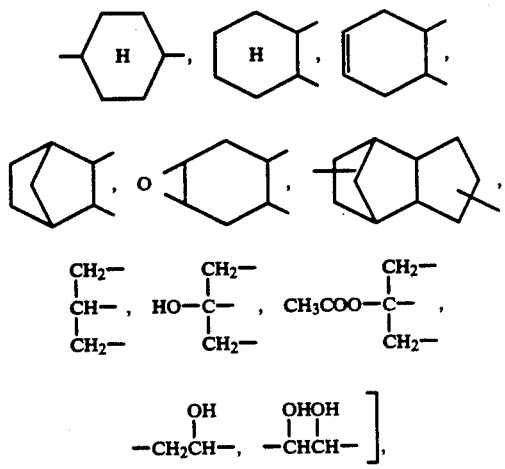

and $W_{11}$ represents an alkyl group of C number from 1 to 24 (and preferably from 4 to 18), a cycloalkyl group of C number from 5 to 24 (and preferably from 6 to 18), or an aryl group of C number from 6 to 24 (and preferably from 6 to 18) (for example, the above-described alkyl groups, cycloalkyl groups and aryl groups described for $R_4$).

In formula (S-6), $W_{12}$ is an alkyl group of C number from 1 to 24 (and preferably from 3 to 20) [for example, n-propyl, 1-ethylpentyl, n-undecyl, pentdecyl, 2,4-di-tert-pentylphenoxymethyl, 4-tert-octylphenoxymethyl, 3-(2,4-di-tert-butylphenoxy)propyl, 1-(2,4-ditert-butylphenoxy)propyl], a cycloalkyl group of C number from 5 to 24 (and preferably from 6 to 18) (for example, cyclohexyl, 4-methylcyclohexyl) or an aryl group of C number from 6 to 24 (and preferably from 6 to 18 (for example, the above-described aryl groups described for Ar), and $W_{13}$ and $W_{14}$ are alkyl groups of C number from 1 to 24 (and preferably from 1 to 18) (for example, methyl, ethyl, isopropyl, n-butyl, n-hexyl, 2-ethylhexyl, n-dodecyl), cycloalkyl groups of C number from 5 to 18 (and preferably from 6 to 15) (for example, cyclopentyl, cyclopropyl) or aryl groups of C number from 6 to 18 (and preferably from 6 to 15) (for example phenyl, 1-naphthyl, p-tolyl). $W_{13}$ and $W_{14}$ may combine and form, together with N, a pyrrolidine ring, a piperidine ring, a morpholine ring, and $W_{12}$ and $W_{13}$ may combine and form a ring.

The chlorinated paraffins which can be used in the present invention may be single compositions or mixtures, and those of average molecular weight from 200 to 2000 (and preferably from 300 to 1000) and of average chlorine content from 30 wt % to 80 wt % (and preferably from 40 wt % to 70 wt %) are preferred.

Actual examples of high boiling point organic solvents which can be represented by the formulae (S-1) to (S-6) are indicated below.

High Boiling Point Organic Solvents Represented by Formula (S-1)

$O{=}P(OC_6H_{13})_3$ S-27

-continued $O{=}P{\leftarrow}OC_{12}H_{25})_3$ S-28

$O{=}P{\leftarrow}OCH_2\underset{\underset{Cl}{|}}{C}HCH_2Cl)_3$ S-29

$O{=}P{\leftarrow}OCH_2CH_2OC_4H_9)_3$ S-30

S-31

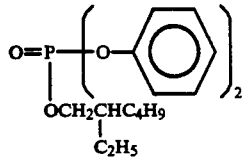

S-32

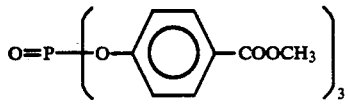

S-33

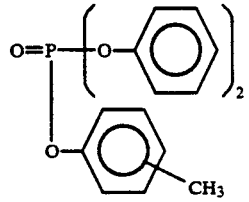

S-34

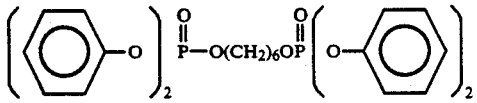

High Boiling Point Organic Solvents Represented by Formula (S-2)

S-35

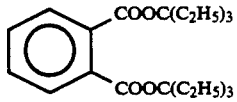

S-36

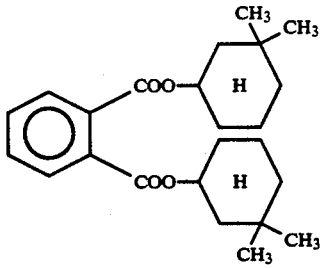

S-37

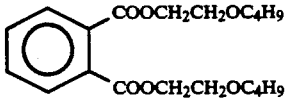

S-38

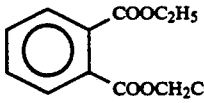

-continued

S-39

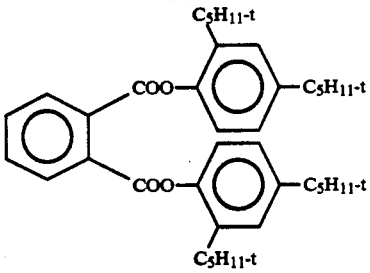

S-40

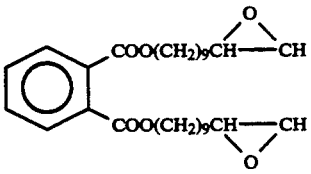

S-41

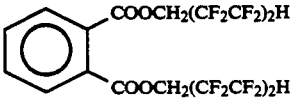

High Boiling Point Organic Solvents Represented by Formula (S-3)

S-42

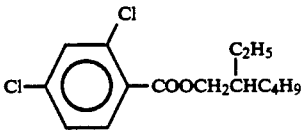

S-43

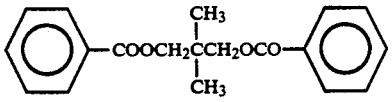

S-44

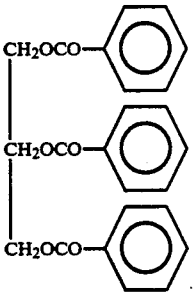

High Boiling Point Organic Solvents Represented by Formula (S-4)

S-45 $C_{15}H_{31}COOC_{16}H_{33}$

S-46 $C_4H_9\underset{\underset{C_2H_5}{|}}{C}HCOOCH_2CH_2OCO\underset{\underset{C_2H_5}{|}}{C}HC_4H_9$ S-47 $C_{13}H_{27}COO\overset{\overset{CH_3}{|}}{C}HCH_2OCH_3$ S-48 $C_4H_9\underset{\underset{C_2H_5}{|}}{C}HCOOCH_2\underset{\underset{CH_3}{|}}{\overset{\overset{CH_3}{|}}{C}}CH_2OCO\underset{\underset{C_2H_5}{|}}{C}HC_4H_9$ High Boiling Point Organic Solvents Represented by Formula (S-5)

-continued

S-49

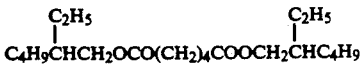

S-50

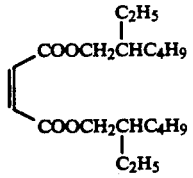

S-51

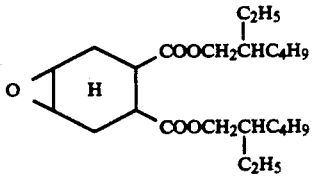

S-52

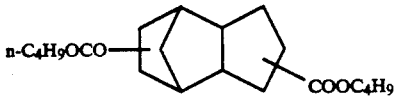

S-53

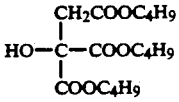

S-54

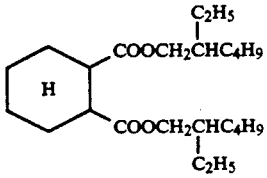

High Boiling Point Organic Solvents Represented by Formula (S-6)

S-55

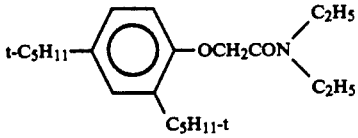

S-56

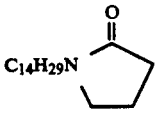

S-57

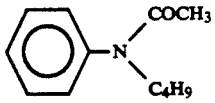

S-58

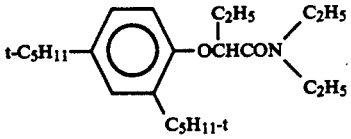

S-59

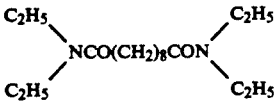

-continued

S-60

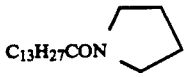

Examples of Chlorinated Paraffins

S-61 $C_{14}H_{25.5}Cl_{4.5}$ (Average Composition)

S-62 $C_{14}H_{24}Cl_6$ (Average Composition)

S-63 $C_{24}H_{44}Cl_6$ (Average Composition)

S-64 $C_{24}H_{29}Cl_{21}$ (Average Composition)

The amount of high boiling point organic solvent employed in the present invention is from 0 to 200 wt%, and preferably from 0 to 50 wt%, with respect to the total amount of cyan couplers represented by formulae (I) and (II) which is used.

A single high boiling point organic solvent can be used individually in the present invention, or two or more such solvents can be used in combination if desired.

The photosensitive materials of the present invention should have, on a support, at least one blue sensitive silver halide emulsion layer, at least one green sensitive silver halide emulsion layer and at least one red sensitive silver halide emulsion layer, but no particular limitation is imposed upon the number of or the order of these silver halide emulsion layers and additional non-photosensitive layers. Typically, silver halide photographic photosensitive materials have, on a support, at least one photosensitive layer comprising a plurality of silver halide layers which have essentially the same color sensitivity but different photographic speeds, these photosensitive layers being a unit photosensitive layer which is color sensitive to blue light, green light or red light. In multi-layer silver halide color photographic materials the arrangement of the unit photosensitive layers generally involves the establishment of the unit photosensitive layers in the order, from the support side, of a red sensitive layer, a green sensitive layer, a blue sensitive layer. However, this order may be changed, as required, and the layers may be arranged in such a way that a layer which has a different color sensitivity is sandwiched between layers which have the same color sensitivity.

Various non-photosensitive layers, such as intermediate layers, may be positioned between the above described silver halide photosensitive layers, and as uppermost and lowermost layers.

These intermediate layers may contain couplers and DIR compounds such as those disclosed in the specifications of JP-A-61-43748, JP-A-59-113438, JP-A-59-113440, JP-A-61-20037 and JP-A-61-20038, and they may also contain anti-color mixing compounds which are generally used.

The plurality of silver halide emulsion layers forming each unit photosensitive layer is preferably a double layer structure comprising a high speed emulsion layer and a low speed emulsion layer as disclosed in West German Patent 1,121,470 or British Patent 923,045. Generally, arrangements in which the photographic speed is lower in the layer closer to the support are preferred, and non-photosensitive layers may be positioned between each of the silver halide emulsion layers. Furthermore, the low speed layers may be arranged on the side furthest away from the support and the high speed layers may be arranged on the side closest to the support as disclosed, for example, in JP-A-57-112751, JP-A-62-200350, JP-A-62-206541 and JP-A-62-206543.

More specifically, the arrangement may be, from the side furthest from the support, low speed blue sensitive layer (BL)/high speed blue sensitive layer (BH)/high speed green sensitive layer (GH)/low speed green sensitive layer (GL)/high speed red sensitive layer (RH)/low speed red sensitive layer (RL), or BH/BL/GL/GH/RH/RL, or BH/BL/GH/GL/RL/RH.

Furthermore, the layers may be arranged in the order, from the side furthest from the support, of blue sensitive layer/GH/RH/GL/RL as disclosed in JP-B-55-34932. (The term "JP-B" as used herein signifies an "examined Japanese patent publication".) Furthermore, the layers can also be arranged in the order, from the side furthest away from the support, of blue sensitive layer/GL/RL/GH/RH, as disclosed in the specifications of JP-A-56-25738 and JP-A-62-63936.

Furthermore, arrangements in which there are three layers which have different speeds with the speed decreasing towards the support with a high speed silver halide emulsion layer at the top, a silver halide emulsion layer which has a lower speed than the above-described layer as an intermediate layer and a silver halide emulsion layer which has a lower speed than the intermediate layer as a bottom layer, as disclosed in JP-B-49-15495, can also be used. In the structures of this type which have three layers with different speeds, the layers in a unit of the same color sensitivity may be arranged in the order, from the side furthest from the support, of intermediate speed emulsion layer/high speed emulsion layer/low speed emulsion layer, as disclosed in the specification of JP-A-59-202464.

Furthermore, the layers may be arranged in the order high speed emulsion layer/low speed emulsion layer/intermediate speed emulsion layer, or low speed emulsion layer/intermediate speed emulsion layer/high speed emulsion layer, for example.

Furthermore, the arrangement may be varied in the ways indicated above where there are four or more layers.

Arrangements in which donor layers (CL) which have a laminating effect and of which the spectral sensitivity distribution differs from that of the principal photosensitive layer such as the BL, GL, RL etc. are adjacent to, or in the proximity of, the principal photosensitive layers, as disclosed in U.S. Pat. Nos. 4,663,271, 4,705,744 and 4,707,436, JP-A-62-106448 and JP-A-63-89580, are preferred for improving color reproduction.

As described above, various layer structures and arrangements can be selected respectively depending on the purpose of the photosensitive material.

Preferred silver halides for use in the photographic emulsion layers of a photographic photosensitive material used in the present invention are silver iodochlorobromides, silver iodochlorides or silver iodochlorobromides which contain about 30 mol % or less of silver iodide. Most preferably, the silver halide is a silver iodobromide or silver iodochlorobromide which contains from about 2 mol% to about 25 mol% of silver iodide.

The silver halide grains in the photographic emulsion may have a regular crystalline form such as a cubic, octahedral or tetradecahedral form, an irregular crystalline form such as a spherical or plate-like form, a form which has crystal defects such as twinned crystal planes, or a form which is a composite of these forms.

The grain size of the silver halide may be very fine and 0.2 micron or less, or large with a projected area diameter of up to about 10 microns, and the emulsions may be poly-disperse emulsions or mono-disperse emulsions.

Photographic emulsions which can be used in the present invention can be prepared, for example, using the methods disclosed in *Research Disclosure* (RD) No. 17643 (December, 1978), pages 22 to 23, "I. Emulsion Preparation and Types", and *Research Disclosure* No. 18716 (November 1979), page 648, in P. Glafkides, *Chemie et Physique Photographic*, published by Paul Montel, 1967, in G. F. Duffin, *Photographic Emulsion Chemistry Chemistry*, published by Focal Press, 1966, and in V. L. Zelikmann et al., *Making and Coating Photographic Emulsions*, published by Focal Press, 1964.

The mono-disperse emulsions disclosed, for example, in U.S. Pat. Nos. 3,574,628 and 3,655,394, and in British Patent 1,413,748, are also preferred.

Furthermore, tabular grains which have an aspect ratio of at least about 5 can be used in the invention. Tabular grains can be prepared easily using the methods described, for example, in Gutoff, *Photographic Science and Engineering*, Volume 14, pages 248 to 257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions. Alternatively, the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms can be used.

The silver halide emulsions used have generally been subjected to physical ripening, chemical ripening and spectral sensitization. Additives which can be used for these purposes are disclosed in *Research Disclosure* Nos. 17643 and 18716, and these disclosures are summarized in the table provided hereinafter.

The use of non-photosensitive fine grain silver halides is preferred in the present invention. Non-photosensitive fine grain silver halides are fine grain silver halides which are not photosensitive at the time of imagewise exposure for obtaining a dye image and which undergo essentially no development during development processing, and those which have not been pre-fogged are preferred.

The fine grain silver halide has a silver bromide content from 0 to 100 mol%, containing silver chloride and/or silver iodide as desired. Those which have a silver iodide content of from 0.5 to 10 mol% are preferred.

The fine grain silver halide preferably has an average grain size (the average value of the diameters circles corresponding to the projected areas) of from 0.01 to 0.5 μm, and most preferably the average grain size is from 0.02 to 0.2 μm.

The fine grain silver halide can be prepared using the same methods used in general for the preparation of photosensitive silver halides. In this case, the surface of the silver halide grains does not need to be optically sensitized and neither is there any need for spectral sensitization. However, the pre-addition of known stabilizers such as triazole, azaindene, benzothiazolium or mercapto based compounds or zinc compounds before addition to the coating liquid is preferred.

Known photographically useful additives which can be used in the present invention are also disclosed in the two *Research Disclosures* referred to above, and these disclosures are also shown in the table below.

| Type of Additive | RD 17643 | RD 18716 |
|---|---|---|
| 1. Chemical Sensitizers | Page 23 | Page 648, right col. |
| 2. Speed Increasing Agents | | As above |
| 3. Spectral Sensitizers and Super-Sensitizers | Pages 23 to 24 | Pages 648 right col. to 649 right col. |
| 4. Whiteners | Page 24 | |
| 5. Anti-Foggants & Stabilizers | Pages 24 to 25 | Page 649, right col. |
| 6. Light Absorbers, Filter Dyes and UV Absorbers | Pages 25 to 26 | Pages 649, right col. to 650, left col. |
| 7. Anti-staining Agents | Page 25, right col. | Page 650, left to right cols. |
| 8. Dye Image Stabilizers | Page 25 | |
| 9. Film Hardening Agents | Page 26 | Page 651, left col. |
| 10. Binders | Page 26 | As above |
| 11. Plasticizers, Lubricants | Page 27 | Page 650, right col. |
| 12. Coating Aids, Surfactants | Pages 26 to 27 | Page 650, right col. |
| 13. Anti-Static Agents | Page 27 | As above |

Furthermore, the addition of compounds which can react with and fix formaldehyde as disclosed in U.S. Pat. Nos. 4,411,987 and 4,435,503 to the photosensitive material is desirable to prevent a deterioration in photographic performance due to formaldehyde gas.

Various color couplers can be used in the present invention in addition to those of the formulae (I) and (II), and actual examples are disclosed in the patents cited in *Research Disclosure* (RD) No. 17643, sections VII-C to G.

Those couplers disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73636, U.S. Pat. Nos. 3,061,432 and 3,725,064, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are especially preferred.

Phenol based and naphthol based couplers are cyan couplers which can be used in combination with the cyan couplers of the formulae (I) and (II), and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121365A and 249453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Typical examples of polymer dye forming couplers have been disclosed, for example, in U.S. Pat. Nos. 3,451,820, 4,080,200, 4,367,282, 4,409,320 and 4,576,910, British Patent 2,101,137 and European Patent 341188A.

The couplers disclosed in U.S. Pat. No. 4,366,237, British Patent 2,125,570, European Patent 96570 and West German Patent (Laid Open) 3,234,533 are preferred as couplers where the colored dyes have a suitable degree of diffusibility.

The colored couplers for correcting unwanted absorption of colored dyes disclosed, for example, in section VII-G of *Research Disclosure* No. 17643, U.S. Pat. No. 4,163,670, JP-B-57-39413, U.S. Pat. No. 4,004,929 and 4,138,258, and British Patent 1,146,368 are preferred. Furthermore, the use of couplers which correct for unwanted absorption of colored dyes by fluorescent dyes which are released on coupling as disclosed in U.S. Pat. No. 4,774,181, and couplers which have, as leaving groups, dye precursors groups which can form dyes on reaction with the developing agent disclosed in U.S. Pat. No. 4,777,120 is also desirable.

The use of couplers which release photographically useful residual groups on coupling is also preferred in the present invention. The DIR couplers which release development inhibitors disclosed in the patents cited in section VII-F of *Research Disclosure* 17643, JP-A-57-151944, JP-A-57-154234, JP-A-60-184248, JP-A-63-37346, JP-A-63-37350, and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in correspondence with image formation during development.

Other compounds which can be used in photo-sensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination as disclosed in European Patents 173302A and 313308A, the bleach accelerator releasing couplers disclosed, for example, in *Research Disclosure* No. 11449, ibid, No. 24241, and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The yellow and magenta couplers which are used in combination in the present invention can be introduced into the photosensitive material using a variety of known methods of dispersion.

Examples of high boiling point solvents which can be used in the oil in water dispersion method are disclosed, for example, in U.S. Pat. No. 2,322,027.

Specific examples of high boiling point organic solvents which have a boiling point of at least 175° C. at normal pressure which can be used in the oil in water dispersion method for yellow and magenta couplers include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate and bis(1,1-diethylpropyl)phthalate), phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridecyl phosphate, tri-butoxyethyl phosphate, trichloropropyl phosphate and di-2-ethylhexyl phenyl phosphonate), benzoic acid esters (for example, 2-ethylhexyl benzoate, dodecyl benzoate, 2-ethylhexyl p-hydroxybenzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)-sebacate, dioctyl azelate, glycerol tributyrate, isostearyl lactate and trioctyl citrate), aniline derivatives (for example, N,N-dibutyl-2-butoxy-5-tertoctylaniline) and hydrocarbons (for example, paraffins, dodecylbenzene and di-isopropylnaphthalene). Furthermore, organic solvents which have a boiling point above about 30° C., and preferably of at least 50° C., but below about 160° C. can be used as auxiliary solvents. Typical examples of these auxiliary solvents include ethyl acetate, butyl acetate, ethyl propionate, methyl ethyl ketone, cyclohexanone, 2-ethoxyethyl acetate and dimethylformamide.

The addition to the color photosensitive materials of the present invention of various fungicides and biocides such as 1,2-benzisothiazolin-3-one, n-butyl p-hydroxybenzoate, phenol, 4-chloro-3,5-dimethylphenol, 2-phenoxyethanol and 2-(4-thiazolyl)benzimidazole disclosed in JP-A-63-257747, JP-A-62-272248 and JP-A-1-80941 or phenethyl alcohol is preferred.

The present invention is applicable to a variety of color photosensitive materials. Typical examples include color negative films for general and cinematographic purposes, color reversal films for slides and television purposes, color papers, color positive films and color reversal papers.

Suitable supports which can be used in the present invention are disclosed, for example, on page 28 of *Research Disclosure* No. 17643, and from the right hand column of page 647 to the left hand column of page 648 of *Research Disclosure* No. 18716.

The photosensitive materials of the present invention are such that the total film thickness of all of the hydrophilic colloid layers on the side where the emulsion layers are located is preferably 28 μm or less, more preferably 23 μm or less, even more preferably 18 μm or less, and most preferably 16 μm or less. Furthermore, the film swelling rate $T_{\frac{1}{2}}$ is preferably not more than 30 seconds and most preferably not more than 20 seconds. Here, the film thickness signifies the film thickness measured under conditions of 25° C. and 55% relative humidity (2 days) and the film swelling rate $T_{\frac{1}{2}}$ is that measured using methods well known to those in the industry. For example, measurements can be made using a swellometer of the type described in A. Green, *Photogr. Sci. Eng.*, Volume 19, Number 2, pages 124 to 129, and $T_{\frac{1}{2}}$ is defined as the time taken to reach half the saturated film thickness, taking 90% of the maximum swollen film thickness reached on processing the material for 3 minutes 15 seconds in a color developer at 30° C. as the saturated film thickness.

The film swelling rate $T_{\frac{1}{2}}$ can be adjusted by adding film hardening agents for the gelatin which is used as a binder, or by changing the aging conditions after coating. Furthermore, the swelling factor is preferably from 150% to 400%. The swelling factor can be calculated from the maximum swollen film thickness obtained under the conditions described above using the equation (maximum swollen film thickness minus film thickness)-/film thickness.

Color photographic photosensitive materials in accordance with the present invention can be developed and processed using usual methods, e.g., those disclosed on pages 28 to 29 of *Research Disclosure* No. 17643 and from the left hand column to the right hand column of page 615 of *Research Disclosure* No. 18716.

The color developers used in the development processing of photosensitive materials of the present invention are preferably aqueous alkaline solutions which contain a primary aromatic amine based color developing agent as the principal component. Aminophenol based compounds are also useful as color developing agents, but the use of p-phenylenediamine based compounds is preferred. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethylN-β-methoxyethylaniline, and the sulfate, hydrochloride and p-toluenesulfonate salts of these compounds. Of these compounds, 3-methyl-4-amino-N-ethyl-N-βhydroxyethylaniline sulfate is especially preferred. Two or more of these compounds can be used in combination, depending on the intended purpose.

The color developer generally contains pH buffers such as alkali metal carbonates, borates or phosphates, and development inhibitors or anti-foggants such as chlorides, bromides, iodides, benzimidazoles, benzothiazoles or mercapto compounds. They may also contain, as required, various preservatives such as hydroxylamine, diethylhydroxylamine, sulfite, hydrazines, such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, thickeners, and various chelating agents exemplified by aminopolycarboxylic acids, aminopolyphosphonic acids, alkylphosphonic acids and phosphonocarboxylic acids. Typical examples of these compounds include ethylenediamine tetraacetic acid, nitrilotriacetic acid, diethylenetriamine pentaacetic acid, cyclohexanediamine tetraacetic acid, hydroxyethyliminodiacetic acid, 1-hydroxyethylidene-1,1-diphosphonic acid, nitrilo-N,N,N-trimethylenephosphonic acid, ethylenediamine-N,N-N,N-tetramethylenephosphonic acid, ethylenediamine-di(o-hydroxyphenylacetic acid) and the salts of these acids.

Furthermore, color development is carried out after a normal black and white development in the case of reversal processing. Known black and white developing agents including dihydroxybenzenes such as hydroquinone, 3-pyrazolidones such as 1-phenyl-3-pyrazolidone, and aminophenols such as N-methyl-p-aminophenol. These compounds can be used individually, or in combination, in the black and white developer.

The pH of the color developers and black and white developers is generally from 9 to 12. Furthermore, the replenishment rate of these developers depends on the color photographic photosensitive material which is being processed but it is generally 3 liters per square meter of photosensitive material or less, the replenishment rate can be 500 ml or less by reducing the bromide ion concentration in the replenisher. Where the replenishment rate is low it is desirable that evaporation and aerial oxidation of the liquid should be prevented by minimizing the area of contact with air in the processing tank.

The contact area between the air and the photographic processing bath in a processing tank can be represented by the open factor which is defined below. Thus:

$$\text{Open Factor} = \frac{\text{Air Contact Area with Processing Bath (cm}^2\text{)}}{\text{Volume of Processing Bath (cm}^3\text{)}}$$

The above-described open factor is preferably 0.1 or less, and most preferably from 0.001 to 0.05. In addition to the use of a shielding material such as a floating lid, for example, on the surface of the photographic processing bath in the processing tank, the method involving the use of a movable lid as disclosed in JP-A-1-82033 and the method involving the slit development processing disclosed in JP-A-63-216050 can be used as means of reducing the open factor. Reduction in the open factor is preferably applied not only to color development and black and white development but also to all the subsequent processes, such as the bleaching, bleach-fixing, water washing and stabilizing. Furthermore, the replenishment rate can be reduced by suppressing the accumulation of bromide ion in the development bath.

The color development processing time is generally between 2 and 5 minutes, but shorter processing times can be achieved by increasing the pH or by increasing the concentration of the color developing agent.

The photographic photosensitive material is generally subjected to a bleaching process after color development. The bleaching process may be carried out at the same time as a fixing process (in a bleach-fix process) or it may be carried out as a separate process. Moreover, a bleach-fix process can be carried out after a bleaching process in order to speed up the processing. Moreover, the processing can be carried out in two connected bleach-fix baths, a fixing process can be carried out before a bleach-fixing process or a bleaching process can be carried out after a bleach-fix process, as desired. Compounds of multi-valent metals, such as iron(III), peracids, quinones and nitro compounds can be used as bleaching agents. Typical bleaching agents include organic complex salts of iron(III), for example, complex salts with aminopolycarboxylic acids such as ethylenediamine tetraacetic acid, diethylenetriamine pentaacetic acid, cyclohexanediamine tetraacetic acid, methylimino diacetic acid, 1,3-diaminopropane tetraacetic acid and glycol ether diamine tetraacetic acid, or citric acid, tartaric acid or malic acid. Of these materials, aminopolycarboxylic acid iron(III) complex salts, principally ethylenediamine tetraacetic acid iron(III) complex salts and 1,3-diaminopropane tetraacetic acid iron(III) salts, are preferred from the standpoints of both rapid processing and the prevention of environmental pollution. Moreover, aminopolycarboxylic acid iron(III) complex salts are especially useful in both bleach baths and bleach-fix baths. The pH of the bleach baths and bleach-fix baths in which these aminopolycarboxylic acid iron(III) salts are used is generally from 4.0 to 8, but lower pH's can be used in order to speed up processing.

Bleaching accelerators can be used, as required, in the bleach baths, bleach-fix baths or bleach or bleach-fix pre-baths. Specific examples of useful bleach accelerators include the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure* No. 17129 (June 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561, the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-40943, JP-A-49-59644, JP-A-53-94927, JP-A-54-35727, JP-A-55-26506 and JP-A-58-163940; and bromide ion. Of these compounds, those which have a mercapto group or a disulfide group are preferred because of their large accelerating effect, and the compounds disclosed in U.S. Pat. No. 3,893,858, West German Patent 1,290,812 and JP-A-53-95630 are especially preferred. Moreover, the compounds disclosed in U.S. Pat. No. 4,552,834 are also preferred. These bleaching accelerators may also be added to the photosensitive materials. These bleaching accelerators are especially effective for bleach-fixing of color photosensitive materials for camera use.

The inclusion of organic acids as well as the compounds described above in the bleach baths and bleach-fix baths is preferred to prevent bleach staining. Compounds which have an acid dissociation constant (pKa) from 2 to 5 are especially preferred as organic acids, and in practice acetic acid and propionic acid, for example, are preferred.

Thiosulfate, thiocyanate, thioether based compounds, thioureas and large amounts of iodide can be used, for example, as the fixing agent which is present in a fixing bath or bleach-fix bath, but thiosulfate is generally used and ammonium thiosulfate in particular can be used in the widest range of applications. Furthermore, the combined use of thiosulfate and thiocyanate, thioether compounds, thiourea etc. is also preferred. Sulfite, bisulfite, carbonyl/bisulfite addition compounds or the sulfinic acid compounds disclosed in European Patent 294769A are preferred as preservatives for fixing baths and bleach-fix baths. Moreover, the addition of various aminopolycarboxylic acids and organophosphonic acids to the fixing baths and bleach-fixing baths is preferred for stabilizing these baths.

The total time of the de-silvering process is preferably as short as possible within the range where insufficient de-silvering does not occur. The preferred de-silvering time is from 1 to 3 minutes, and most preferably the de-silvering time is from 1 to 2 minutes. Furthermore, the processing temperature is from 25° C. to 50° C., and preferably from 35° C. to 45° C. The de-silvering rate is improved and staining after processing is effectively prevented within the preferred temperature range.

The de-silvering baths are preferably agitated as strongly as possible during the de-silvering process. Specific examples of methods of strong agitation include methods in which a processing bath is jetted against the emulsion surface of the photosensitive material as disclosed in JP-A-62-183460, methods in which the agitation effect is increased using a rotary device as disclosed in JP-A-62-183461, methods in which the photosensitive material is moved with a wiper blade which is established in the bath in contact with the emulsion surface and the agitation effect is increased by the generation of turbulence at the emulsion surface, and methods in which the circulating flow rate of the processing bath as a whole is increased. These means of increasing the agitation are effective in bleach baths, bleach-fix baths and fixing baths. It is thought that increased agitation enhances the rate of supply of the bleaching agent and the fixing agent to the emulsion film and consequently enhances the de-silvering rate. Furthermore, the above-described means of increasing agitation are more effective where a bleaching accelerator is used, and they sometimes provide a marked increase in the accelerating effect and eliminate the fixer inhibiting action of the bleaching accelerator.

The automatic processors used for photosensitive materials of the present invention preferably have photosensitive material transporting devices as disclosed in JP-A-60-191257, JP-A-60-191258 or JP-A-60-191259. With such a transporting device, such as that disclosed in JP-A-60-191257, the carry over of processing liquid from one bath to the next is greatly reduced and this is very effective for preventing a deterioration in processing bath performance. These effects are especially useful for reducing the processing time in each process and for reducing the replenishment rate of each processing bath.

The silver halide color photographic photosensitive materials of this invention are generally subjected to a water washing process and/or stabilizing process after the de-silvering process. The amount of wash water used in the washing process can be varied over a wide range, depending on the application and the nature (depending on the materials such as couplers used, for example) of the photosensitive material, the wash water temperature, the number of water washing tanks (the number of water washing stages) and the replenishment system, i.e. whether a counter flow or a sequential flow system is used, and various other conditions. The relationship between the amount of water used and the number of washing tanks in a multistage counter-flow system can be obtained using the outlined on pages 248 to 253 of the *Journal of the Society of Motion Picture and Television Engineers*, Volume 64 (May 1955).

The amount of wash water used can be greatly reduced by using the multi-stage counter-flow system described in the aforementioned literature, but bacteria proliferate due to the increased residence time of the water in the tanks. Thus, problems arise with suspended matter which is produced and which attaches to the photosensitive material. The method in which calcium ion and magnesium ion concentrations are reduced, as disclosed in JP-A-62-288838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in Horiguchi, *The Chemistry of Biocides and Fungicides* (1986, Sanko Shuppan), in *Killing Micro-organisms, Biocidal and Fungicidal Techniques* (1982) published by Association of Sanitary Technique, and in *A Dictionary of Biocides and Fungicides*, (1986) published by the Japanese Biocide and Fungicide Society, can also be used.

The pH value of the washing water when processing the photosensitive materials of the present invention is from 4 to 9, and preferably from 5 to 8. The washing water temperature and the washing time can vary depending on the nature and application of the photosensitive material but, in general, washing conditions from 20 seconds to 10 minutes at a temperature from 15° C. to 45° C., and preferably from 30 seconds to 5 minutes at a temperature from 25° C. to 40° C., are employed. Moreover, the photosensitive materials of this invention can be processed directly in a stabilizing bath instead of being subjected to a water wash as described above. Known methods disclosed in JP-A-57-8543, JP-A-58-14834 and JP-A-60-220345 can be used for a stabilization process of this type.

Furthermore, in some cases a stabilization process is carried out following the above-described water washing process. Stabilizing baths which contain dye stabilizing agents and surfactants which are used as final baths for color photosensitive materials for camera use are an example of such a process. Aldehydes such as formaldehyde and glutaraldehyde, N-methylol compounds, hexamethylenetetramine and aldehyde/bisulfite addition compounds can be used, for example, as dye stabilizing agents.

Various chelating agents and fungicides can also be added to these stabilizing baths.

The overflow which accompanies replenishment of the above described water washing or stabilizing baths can be reused in other processes, such as the de-silvering process, for example.

Concentration correction with the addition of water is desirable in cases where the above described processing baths become concentrated due to evaporation when processing in an automatic processor, for example.

Color developing agents can be incorporated into a silver halide color photosensitive material of the present invention to simplify and speed up the processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599 and *Research Disclosure* No. 14850 and ibid, No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be incorporated, as desired, into the silver halide color photosensitive material of the present invention to accelerate color development. Typical compounds are disclosed, for example, in JP-A-56-64339, JP-A-57-144547 and JP-A-58-115438.

The processing baths in the present invention are used at a temperature from 10° C. to 50° C. The standard temperature is generally from 33° C. to 38° C., but accelerated processing and shorter processing times can be achieved at higher temperatures while, on the other hand, increased picture quality and better processing bath stability can be achieved at lower temperatures.

Furthermore, the silver halide photosensitive materials of the present invention can be used as heat developable photosensitive materials as disclosed, for example, in U.S. Pat. No. 4,500,626, JP-A-60-133449, JP-A-59-218443, JP-A-61-238056 and European Patent 210660A2.

The present invention is described in greater detail below by means of illustrative examples, but the invention is not to be construed as being limited to these examples. Unless otherwise indicated, all parts, percents, ratios and the like are by weight.

EXAMPLE 1

Photosensitive materials (Samples 101 to 115) which form a single color and which comprise two layers, namely an emulsion layer and a protective layer, on an under-coated cellulose triacetate support were prepared with the compositions indicated below. The numerical values indicated are in g/m$^2$ except for the couplers (in the case of silver halides the value is shown as silver).

| | |
|---|---|
| **Emulsion Layer** | |
| Silver Iodobromide Emulsions as silver (2 mol % AgI, average grain size 0.3 μm) | 0.8 |
| Gelatin | 1.2 |
| Coupler (see Table 1) Units: mol/m$^2$ | 0.001 |
| High Boiling Point Organic Solvent (see Table 1) or additive | 0.3 |
| **Protective Layer** | |
| Gelatin | 0.9 |
| Poly(methyl methacrylate) Particles (diameter 1.5 μm) | 0.4 |
| 1-Oxy-3,5-dichloro-s-triazine sodium salt | 0.04 |

The samples prepared in this way (Samples 101 to 115) were cut into strips of a length of 120 mm and a width of 35 mm and, after exposure to white light at an exposure intensity of 40 CMS using a continuous density wedge, the samples were developed and processed in the manner described below.

| Color Development Processing | |
|---|---|
| Color Development | 3 minutes 15 seconds |
| Bleach | 6 minutes 30 seconds |
| Fix | 4 minutes 20 seconds |
| Water Wash | 5 minutes |
| Stabilization | 1 minute |

The compositions of the processing baths used for each process was as shown below.

| Color Development Bath | |
|---|---|
| Diethylenetriamine Pentaacetic Acid | 1.0 gram |
| 1-Hydroxyethylidene-1,1-diphosphonic Acid | 2.0 grams |
| Sodium Sulfite | 4.0 grams |
| Potassium Carbonate | 30.0 grams |
| Potassium Bromide | 1.4 grams |
| Potassium Iodide | 1.3 mg |
| Hydroxylamine Sulfate | 2.4 grams |
| 4-(N-Ethyl-N-β-hydroxyethylamino)-2-methylaniline Sulfate | 4.5 grams |
| Water to make up to | 1.0 liter |
| pH | 10.0 |
| **Bleach bath** | |
| 1,3-Diaminopropane Tetraacetic Acid, Ferric Ammonium Salt | 105.0 grams |
| Ammonia (28% aq. soln.) | 3.0 ml |
| Ammonium Bromide | 150.0 grams |
| Ammonium Nitrate | 10.0 grams |
| Water to make up to | 1.0 liter |
| pH | 4.2 |
| **Fixer Bath** | |
| Ethylenediamine Tetraacetic Acid, Di-sodium Salt | 1.0 gram |
| Sodium Sulfite | 4.0 grams |
| Ammonium Thiosulfate (70% wt/vol aq. soln.) | 175.0 ml |
| Sodium Bisulfite | 4.0 grams |
| Water to make up to | 1.0 liter |
| pH | 6.6 |
| **Stabilizing Bath** | |
| Formaldehyde (40% aq. soln.) | 2.0 ml |
| Polyoxyethylene p-Monononylphenyl Ether (average degree of polymerization about 10) | 0.3 gram |
| Water to make up to | 1.0 liter |

The gamma value (the gradient of the line joining the points of density 0.5 to 1.0 on the sensitometric curve) and $D_{max}$ value (the maximum color density) of the cyan colored samples (Samples 101 to 115) obtained in the color development process were measured. The results are shown in Table 1 below. Each value is shown as a relative value taking the measured value for Sample 101 to be 1.

Comparative Compounds (A-1) Illustrative Coupler (33) disclosed in JP-A-59-24848

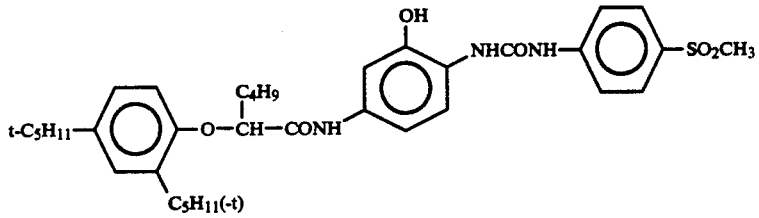

(A-2) Illustrative Compound II-1 Disclosed in JP-A-59-24848

(High Boiling Point Organic Solvent)

n-$C_{15}H_{31}COOC_2H_5$ (B-1) Illustrative Couplers (I-3) Disclosed in JP-A-61-36746

-continued

Comparative Compounds

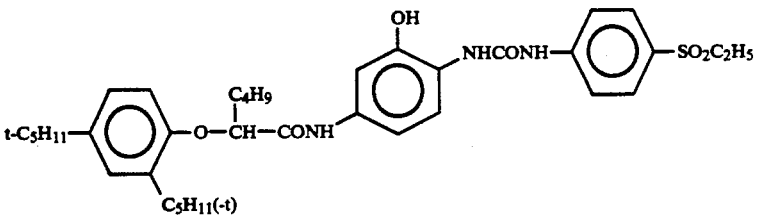

(B-2) Phenol Compound (P-7) Disclosed in JP-A-61-36746

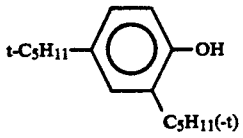

(B-3) Amino Compound II-4 Disclosed in JP-A-61-36746

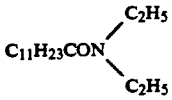

TABLE 1

| Sample No. | Coupler (mol %) (wt % in parentheses) | | High Boiling Point Organic Solvent (wt % in parentheses) | | Gamma Value | $D_{max}$ |
|---|---|---|---|---|---|---|
| 101 (Comparative Example) | A-1 | 100 | A-2 | (100) | 1.00 | 1.00 |
| 102 (Comparative Example) | B-1 | 100 | B-2<br>B-3 | (50)<br>(50) | 0.96 | 0.98 |
| 103 (Comparative Example) | I-1 | 100 | S-6 | (100) | 1.45 | 1.55 |
| 104 (This Invention) | I-1<br>II-1 | 20 (20)<br>80 (80) | S-6 | (100) | 1.15 | 1.17 |
| 105 (This Invention) | I-5<br>II-3 | 50 (46)<br>50 (54) | S-6 | (100) | 1.25 | 1.21 |
| 106 (This Invention) | I-8<br>II-4 | 90 (90)<br>10 (10) | S-6 | (100) | 1.36 | 1.35 |
| 107 (This Invention) | I-10<br>II-5 | 90 (90)<br>10 (10) | S-6<br>A-27 | (80)<br>(20) | 1.35 | 1.37 |
| 108 (This Invention) | I-12<br>II-6 | 90 (90)<br>10 (10) | S-1<br>S-2 | (80)<br>(20) | 1.30 | 1.31 |
| 109 (This Invention) | I-13<br>II-13 | 90 (91)<br>10 (9) | S-6<br>S-18 | (80)<br>(20) | 1.33 | 1.34 |
| 110 (This Invention) | I-14<br>II-15 | 90 (90)<br>10 (10) | S-38<br>S-44 | (50)<br>(50) | 1.67 | 1.36 |
| 111 (This Invention) | I-19<br>II-16 | 90 (91)<br>10 (9) | S-1<br>S-17 | (50)<br>(50) | 1.58 | 1.32 |
| 112 (This Invention) | I-20<br>II-17 | 90 (91)<br>10 (9) | S-6<br>S-17 | (80)<br>(20) | 1.60 | 1.34 |
| 113 (This Invention) | I-1<br>II-1 | 90 (90)<br>10 (10) | None | | 1.25 | 1.23 |
| 114 (This Invention) | I-5<br>II-1 | 90 (91)<br>10 (9) | S-12 | (100) | 1.36 | 1.36 |
| 115 (This Invention) | I-8<br>II-1 | 90 (90)<br>10 (10) | S-7<br>S-17 | (80)<br>(20) | 1.34 | 1.33 |

TABLE 1-continued

| Sample No. | Coupler (mol %) (wt % in parentheses) | High Boiling Point Organic Solvent (wt % in parentheses) | Gamma Value | $D_{max}$ |
|---|---|---|---|---|
| Invention) | | | | |

Next, Samples 101 to 115 were allowed to stand under conditions of temperature 50° C., 80% relative humidity and then they were exposed and color developed in the same manner as described above and the $D_{max}$ values were measured.

The reduction in $D_{max}$ ($\Delta D_{max}$) due to storage under conditions of high temperature and high humidity was as shown in Table 2 below.

$$\Delta D_{max} = \frac{D_{max}\text{ (Before Ageing)} - D_{max}\text{ (After Ageing)}}{D_{max}\text{ (Before Ageing)}}$$

TABLE 2

| Sample Number | $\Delta D_{max}$ |
|---|---|
| 101 (Comp. Ex.) | 0.12 |
| 102 (Comp. Ex.) | 0.10 |
| 103 (Comp. Ex.) | 0.45 |
| 104 (Invention) | 0.10 |
| 105 (Invention) | 0.10 |
| 106 (Invention) | 0.09 |
| 107 (Invention) | 0.10 |
| 108 (Invention) | 0.08 |
| 109 (Invention) | 0.07 |
| 110 (Invention) | 0.10 |
| 111 (Invention) | 0.08 |
| 112 (Invention) | 0.07 |
| 113 (Invention) | 0.12 |
| 114 (Invention) | 0.10 |
| 115 (Invention) | 0.07 |

In is clear from the results shown in Tables 1 and 2 above that the photosensitive materials of the present invention have a high gamma value (coupler coupling reactivity) and a high maximum color density, and that there is no problem with a decrease in $D_{max}$ due to precipitation of the coupler.

EXAMPLE 2

Multi-layer silver halide photosensitive materials (Samples 201 to 214) were prepared by coating a photosensitive layer of the composition shown below on an under-coated cellulose triacetate support.

Photosensitive Layer Composition

The numerical values corresponding to each component indicate the coated weight expressed in g/m², and, in the case of the silver halides, the coated weight is indicated as silver. In the case of the sensitizing dyes the amount coated is indicated as mol per mol of silver halide in the same layer.

| | |
|---|---|
| **First Layer (Anti-halation Layer)** | |
| Black Colloidal Silver as silver | 0.18 |
| Gelatin | 2.0 |
| **Second Layer (Intermediate Layer)** | |
| 2,5-Di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 0.88 |
| **Third Layer (First Red Sensitive Emulsion Layer)** | |
| Emulsion A as silver | 0.25 |
| Emulsion B as silver | 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Coupler (see Table 3) | $6.3 \times 10^{-4}$ (mol/m²) |
| EX-10 | 0.020 |
| High Boiling Point Organic Solvent | 0.060 |
| Gelatin | 0.73 |
| **Fourth Layer (Second Red Sensitive Emulsion Layer)** | |
| Emulsion G as silver | 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Coupler (see Table 3) | $7.5 \times 10^{-4}$ (mol/m²) |
| EX-3 | 0.020 |
| EX-4 | 0.030 |
| EX-10 | 0.015 |
| High Boiling Point Organic Solvent | 0.060 |
| Gelatin | 1.1 |
| **Fifth Layer (Third Red Sensitive Emulsion Layer)** | |
| Emulsion D as silver | 1.60 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.39 |
| **Sixth Layer (Intermediate Layer)** | |
| EX-5 | 0.040 |
| HBS-1 | 0.020 |
| Gelatin | 0.68 |
| **Seventh Layer (First Green Sensitive Emulsion Layer)** | |
| Emulsion A as silver | 0.15 |
| Emulsion B as silver | 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |

-continued

| | |
|---|---|
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.53 |
| **Eighth Layer (Second Green Sensitive Emulsion Layer)** | |
| Emulsion C as silver | 0.45 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.43 |
| **Ninth Layer (Third Green Sensitive Emulsion Layer)** | |
| Emulsion E as silver | 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-14 | 0.015 |
| EX-11 | 0.100 |
| EX-1 | 0.025 |
| HBS-1 | 0.025 |
| HBS-2 | 0.10 |
| Gelatin | 1.31 |
| **Tenth Layer (Yellow Filter Layer)** | |
| Yellow Colloidal Silver as silver | 0.05 |
| EX-5 | 0.08 |
| HBS-1 | 0.03 |
| Gelatin | 0.81 |
| **Eleventh Layer (First Blue Sensitive Emulsion Layer)** | |
| Emulsion A as silver | 0.08 |
| Emulsion B as silver | 0.07 |
| Emulsion F as silver | 0.07 |
| Sensitizing Dye VIII | $3.5 \times 10^{-4}$ |
| EX-9 | 0.72 |
| EX-8 | 0.042 |
| HBS-1 | 0.28 |
| Gelatin | 0.94 |
| **Twelfth Layer (Second Blue Sensitive Emulsion Layer)** | |
| Emulsion G as silver | 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.66 |
| **Thirteenth Layer (Third Blue Sensitive Emulsion Layer)** | |
| Emulsion H as silver | 0.77 |
| Sensitizing Dye VIII | $2.2 \times 10^{-4}$ |
| EX-15 | 0.20 |
| HBS-1 | 0.07 |
| Gelatin | 0.69 |
| **Fourteenth Layer (First Protective Layer)** | |
| Emulsion I as silver | 0.5 |
| U-4 | 0.11 |
| U-5 | 0.17 |
| HBS-1 | 0.05 |
| Gelatin | 0.85 |
| **Fifteenth Layer (Second Protective Layer)** | |
| Poly(methyl acrylate) Particles (diameter about 1.5 μm) | 0.54 |
| S-1 | 0.20 |
| Gelatin | 1.02 |

Gelatin Hardening Agent H-1 and sodium dodecylbenzenesulfonate as surfactants were added to each layer in addition to the components described above. The amount of H-1 was about 2% based on the amount of gelatin in each layer, and that of sodium dodecylbenzenesulfonate was about 10% based on the amount of coupler.

| | Average AgI Content (%) | Average Grain Size (μm) | Variation Coefficient of Grain Size (%) | Diameter/ Thickness Ratio | Silver Amount Ratio (AgI Content %) |
|---|---|---|---|---|---|
| Emulsion A | 4.1 | 0.45 | 27 | 1 | Core/Shell = 1/3 (13/1) Double Structure Grains |
| Emulsion B | 8.9 | 0.70 | 14 | 1 | Core/Shell = 3/7 (25/2) Double Structure Grains |
| Emulsion C | 10 | 0.75 | 30 | 2 | Core/Shell = 1/2 (24/3) Double Structure Grains |
| Emulsion D | 16 | 1.05 | 35 | 2 | Core/Shell = 1/2 (40/0) Double Structure Grains |
| Emulsion E | 10 | 1.05 | 35 | 3 | Core/Shell = 1/2 (24/3) Double Structure Grains |
| Emulsion F | 4.1 | 0.25 | 28 | 1 | Core/Shell = 1/3 (13/1) Double Structure Grains |
| Emulsion G | 13.6 | 0.75 | 25 | 2 | Core/Shell = 1/2 (40/0) Double Structure Grains |
| Emulsion H | 14 | 1.30 | 25 | 3 | Core/Shell = 37/63 (34/3) Double Structure Grains |
| Emulsion I | 1 | 0.07 | 15 | 1 | Uniform Grains |

EX-1

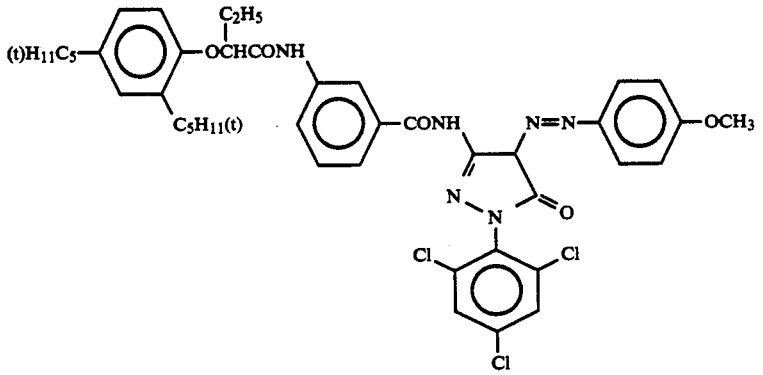

EX-2

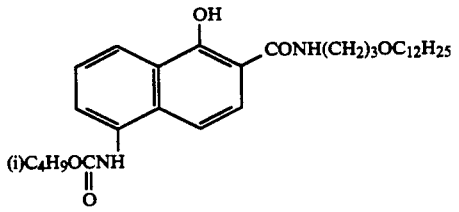

EX-3

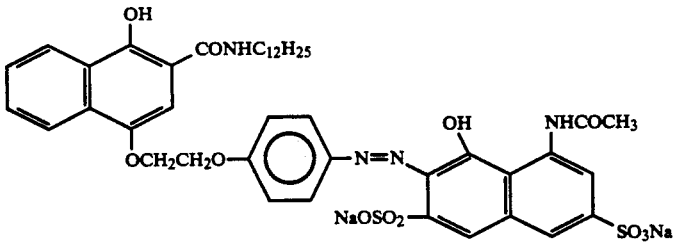

EX-4

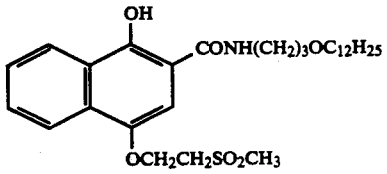

EX-5

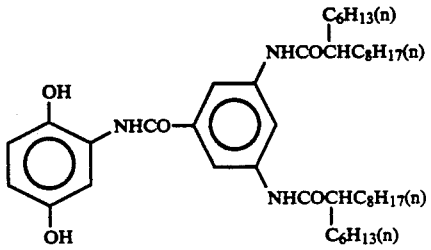

-continued
EX-6
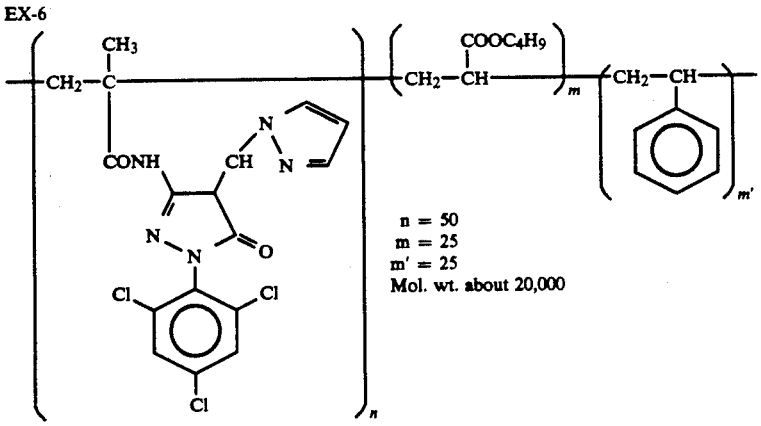
EX-7
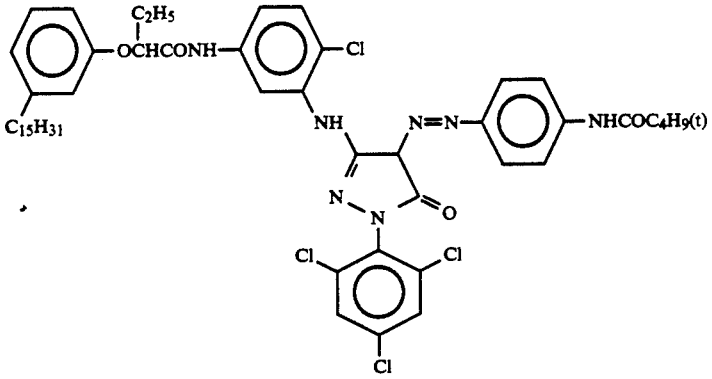
EX-8
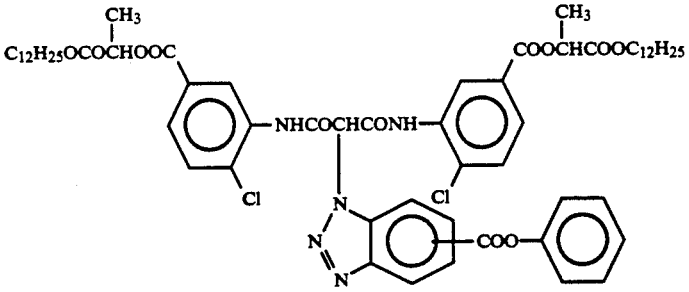
EX-9
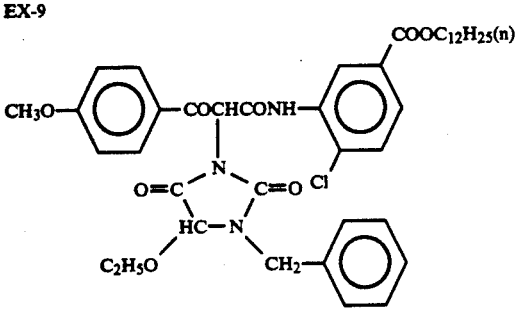
EX-10
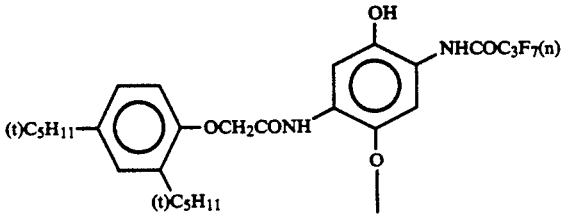

-continued
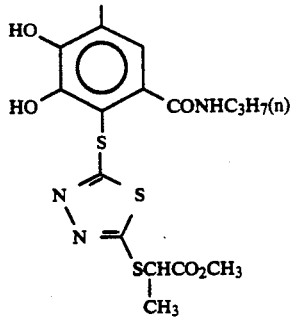
EX-11
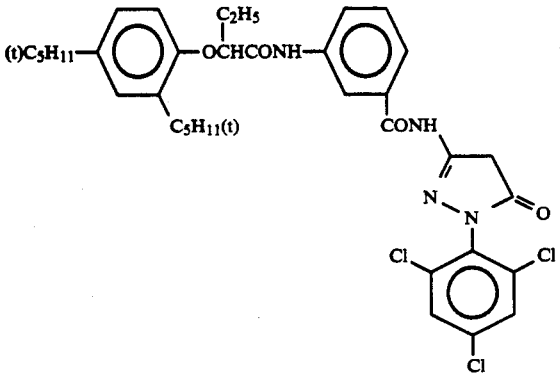
X-12
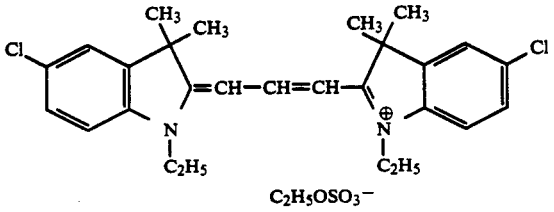
EX-13
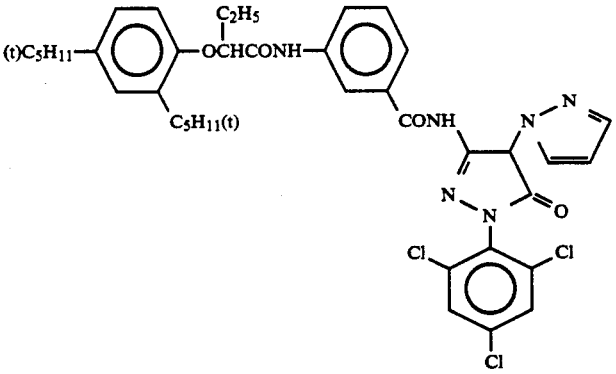
EX-14
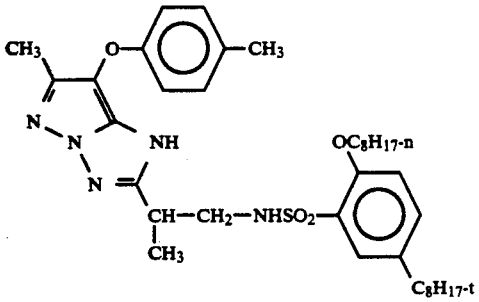
EX-15
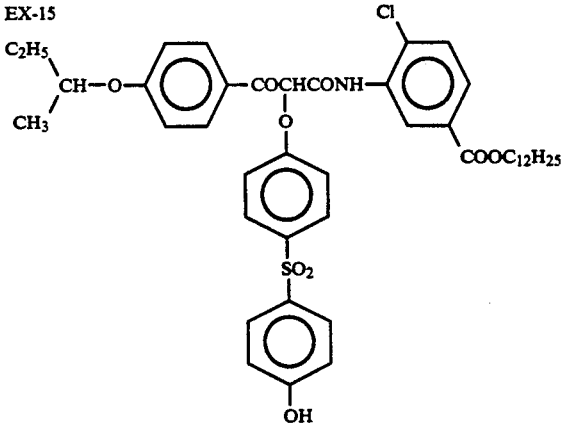

-continued
U-1
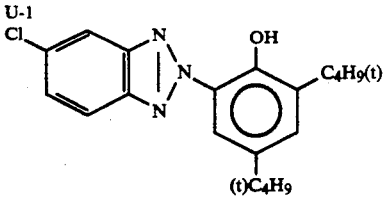
U-2
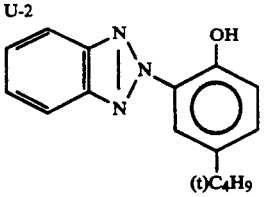
U-3
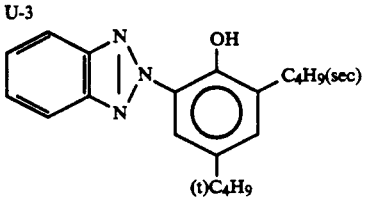
U-4
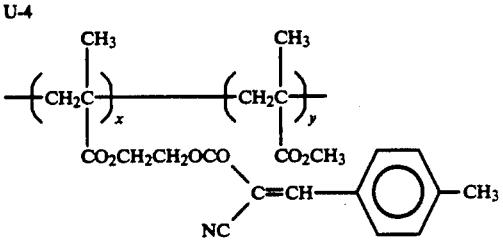
x:y = 70:30 (wt %)
UV-5
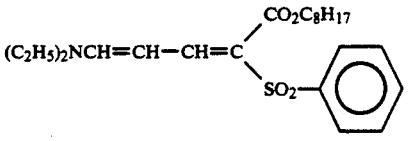
HBS-1
Tricresyl Phosphate
HBS-2
Di-n-butyl Phthalate
HBS-3
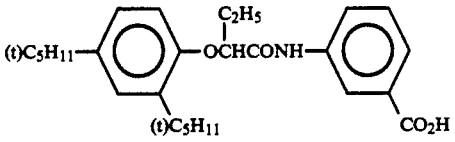
Sensitizing Dye I
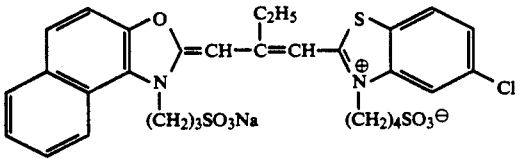
Sensitizing Dye II
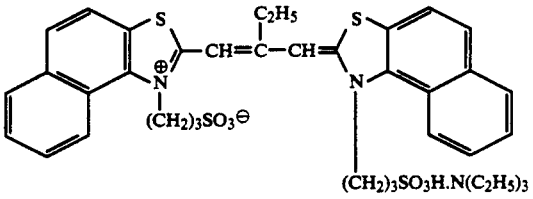
Sensitizing Dye III
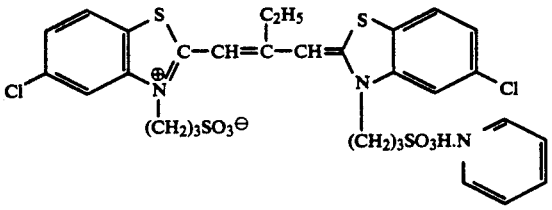
Sensitizing Dye V
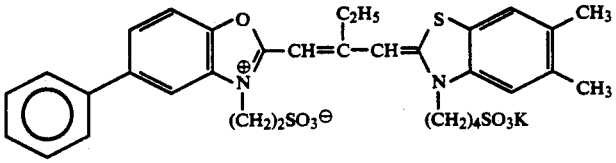

-continued

Sensitizing Dye VI

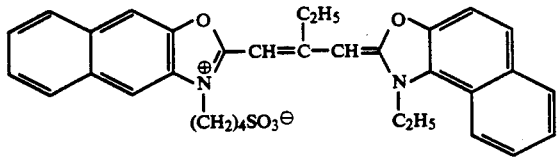

Sensitizing Dye VII

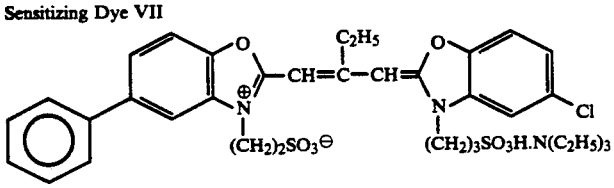

Sensitizing Dye VIII

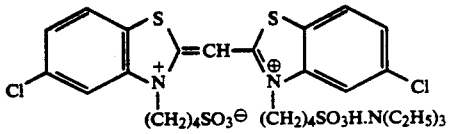

S-1

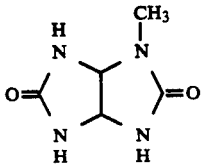

H-1

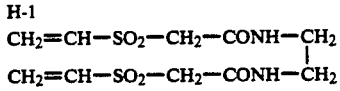

The overall dry film thickness of the coated layers, excluding the support and the support underlayer, of Samples 201 to 214 prepared was from 16.5 μ to 18.4 μ.

Samples (201 to 214) prepared in this manner were cut and finished into strips of a width of 35 mm and then they were subjected to a wedge exposure with red light.

Next, the samples were processed in a negative type automatic processor using the processing operation described below. The samples used for performance evaluation were processed after processing the samples which had been subjected to an imagewise exposure to the extent that the amount of replenisher added to the color developer had reached three times the parent bath tank capacity.

| | Processing Operations | | | |
|---|---|---|---|---|
| Process | Processing Time | Processing Temp. | Replenishment Rate* | Tank Capacity |
| Color Development | 31 min. 15 sec. | 37.8° C. | 23 ml | 10 liters |
| Bleach | 40 seconds | 38.0° C. | 5 ml | 5 liters |
| Fix | 1 min. 30 sec. | 38.0° C. | 30 ml | 10 liters |
| Water Wash (1) | 30 seconds | 38.0° C. | — | 5 liters |
| Water Wash (2) | 30 seconds | 38.0° C. | 30 ml | 5 liters |
| Stabilization | 30 seconds | 38.0° C. | 20 ml | 5 liters |
| Drying | 1 minute | 55° C. | | |

*Replenishment rate per meter of 35 mm wide material
The water wash was a counter flow system from (2) to (1)

The composition of the processing baths was as indicated below.

| | Parent Bath (grams) | Replenisher (grams) |
|---|---|---|
| **Color Development Bath** | | |
| Diethylenetriamine Pentaacetic Acid | 1.0 | 1.1 |
| 1-Hydroxyethylidene-1,1-diphosphonic Acid | 3.0 | 3.2 |
| Sodium Sulfite | 4.0 | 4.9 |
| Potassium Carbonate | 30.0 | 30.0 |
| Potassium Bromide | 1.4 | — |
| Potassium Iodide | 1.5 mg | — |
| Hydroxylamine Sulfate | 2.4 | 3.6 |
| 2-Methyl-4-[N-ethyl-N-(β-hydroxyethyl)amino]aniline Sulfate | 4.5 | 6.4 |
| Water to make | 1.0 liter | 1.0 liter |
| pH | 10.05 | 10.10 |
| **Bleach Bath** | | |
| 1,3-Diaminopropane Tetraacetic Acid, Ferric Ammonium Salt, Mono-hydrate | 144.0 | 206.0 |
| 1,3-Diaminopropane Tetraacetic Acid | 2.8 | 4.0 |
| Ammonium Bromide | 84.0 | 120.0 |
| Ammonium Nitrate | 30.0 | 41.7 |
| Acetic Acid (98% aq. soln) | 50.0 | 72.5 |
| Water to make | 1.0 liter | 1.0 liter |
| pH (adjusted with aqueous ammonia (27%)) | 4.0 | 3.2 |
| **Fixer Bath Parent Bath = Replenisher (Units: Grams)** | | |
| Ethylene Diamine Tetraacetic Acid, Di-ammonium Salt | | 1.7 |
| Ammonium Sulfite | | 14.0 |
| Aammonium Thiosulfate (700 g/l aq. soln.) | | 340.0 ml |
| Water to make | | 1.0 liter |
| pH | | 7.0 |

Water Washing Water Parent Bath = Replenisher

Town water was passed through a mixed bed type column which was packed with an H-type strongly acidic cation exchange resin ("Amberlite IR-120B", made by the Rohm and Haas Co.) and an OH-type strongly basic anion exchange resin ("Amberlite IRA-400", made by the Rohm and Haas Co.) and treated such that the calcium and magnesium ion concentrations were not more than 3 mg/ml, after which 20 mg/l of sodium isocyanurate dichloride and 150 mg/l of sodium sulfate were added. The pH of this solution was within the range from 6.5 to 7.5.

-continued

| Stabilizing Bath Parent Bath = Replenisher (Units: Grams) | |
|---|---|
| Formaldehyde (37% aq. soln.) | 1.2 ml |
| Surfactant [$C_{10}H_{21}$—O—$(CH_2CH_2O)_{20}$—H] | 0.4 |
| Ethylene Glycol | 1.0 |
| Water to make | 1.0 liter |
| pH | 5.0 to 7.0 |

The colored samples (Samples 201 to 214) obtained by development processing were subjected to red density measurements using a Fuji model densitometer. The density of each sample at the exposure required to provide a density of 1.0 for Sample 201 is shown in Table 3 below.

TABLE 3

| Sample No. | Coupler (mol %) (wt % in parentheses) | | High Boiling Point Organic Solvent (wt % in parentheses) | | Density |
|---|---|---|---|---|---|
| 201 (Comparative Example) | A-1 | 100 | A-2 | (100) | 1.00 |
| 202 (Comparative Example) | B-1 | 100 | B-2<br>B-3 | (50)<br>(50) | 0.99 |
| 203 (This Invention) | I-1<br>II-1 | 20 (20)<br>80 (80) | S-6 | (100) | 1.11 |
| 204 (This Invention) | I-5<br>II-3 | 50 (46)<br>50 (54) | S-6 | (100) | 1.20 |
| 205 (This Invention) | I-8<br>II-4 | 90 (90)<br>10 (10) | S-6 | (100) | 1.28 |
| 206 (This Invention) | I-10<br>II-5 | 90 (90)<br>10 (10) | S-6<br>S-27 | (80)<br>(20) | 1.29 |
| 207 (This Invention) | I-12<br>II-6 | 90 (90)<br>10 (10) | S-1<br>S-2 | (80)<br>(20) | 1.24 |
| 208 (This Invention) | I-13<br>II-13 | 90 (91)<br>10 (9) | S-6<br>S-18 | (80)<br>(20) | 1.26 |
| 209 (This Invention) | I-14<br>II-15 | 90 (90)<br>10 (10) | S-38<br>S-44 | (80)<br>(20) | 1.32 |
| 210 (This Invention) | I-19<br>II-16 | 90 (91)<br>10 (9) | S-1<br>S-17 | (50)<br>(50) | 1.23 |
| 211 (This Invention) | I-20<br>II-17 | 90 (91)<br>10 (9) | S-6<br>S-17 | (50)<br>(50) | 1.26 |
| 212 (This Invention) | I-1<br>II-1 | 90 (90)<br>10 (10) | None | | 1.21 |
| 213 (This Invention) | I-5<br>II-1 | 90 (91)<br>10 (9) | S-12 | (100) | 1.31 |
| 214 (This Invention) | I-8<br>II-1 | 90 (90)<br>10 (10) | S-7<br>S-17 | (80)<br>(20) | 1.26 |

It is clear from the results in Table 3 that multi-layer photosensitive materials of the present invention have better color forming properties than the comparative examples.

It is clear from the results described above that the coupling reactivity of the coupler used in the present invention is increased and that silver halide color photographic photosensitive materials in which dyes are formed have a high adsorption density are obtained.

While the invention has been described in detail and with reference to specific embodiments thereof, it will be apparent to one skilled in the art that various changes and modifications can be made therein without departing from the spirit and scope thereof.

What is claimed is:

1. A photographic photosensitive material comprising a support having thereon at least one silver halide emulsion layer, said photosensitive material containing at least one cyan dye forming coupler represented by formula (I):

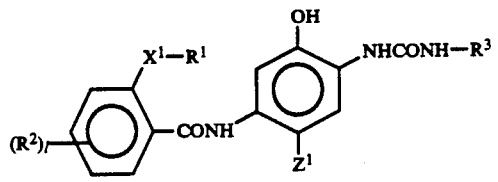

(I)

and at least one cyan dye forming coupler represented by formula (II):

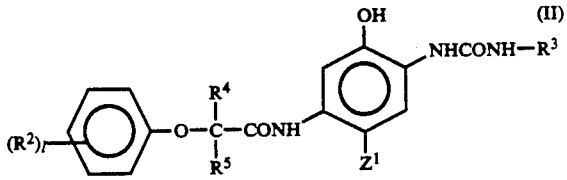

(II)

in proportions, respectively, from 20 to 99 wt % and from 1 to 80 wt %, based on the total amount of both couplers of formulae (I) and (II), wherein $R^1$ represents a substituted or unsubstituted alkyl group, alkenyl group, alkynyl group, cycloalkyl group or aryl group; $X^1$ represents a single bond, —O—, —S—, —SO—, $—SO_2—$, —COO—, $$—\underset{\underset{R^6}{|}}{CON}—,\quad —SO_2O—,\quad —\underset{\underset{R^6}{|}}{SO_2N}—\quad \text{or}\quad —\underset{\underset{R^7}{|}}{N}—;$$

$R^2$ represent a group which can be substituted on a benzene ring; l represents an integer from 0 to 4; R3 is selected from the group consisting of 4-cyanophenyl, 4-cyano-3-halogenophenyl, 3-cyano-4-halogenophenyl, 4-alkylsulfonylphenyl, 4-alkylsulfonyl-3-halogenophenyl, 4-alkylsulfonyl-3-alkoxyphenyl, 3-alkoxy-4-alkylsulfonyl-phenyl, 3,4-dihalogenophenyl, 4-halogenophenyl, 3,4,5-trihalogenophenyl, 3,4-dicyanophenyl, 3-cyano-4,5-dihalogenophenyl, 4-trifluoromethylphenyl and 3-sulfonamidophenyl; $R^4$ and $R^5$ each independently represent a hydrogen atom, an alkyl group, an alkenyl group, an alkynyl group, a cycloalkyl group, an acyl group, an alkoxycarbonyl group or an aryl group; $Z^1$ represents a hydrogen atom or a coupling-off group; $R^6$ represents a hydrogen atom, an acyl group or a group as defined for $R^1$; and $R^7$ represents a hydrogen atom or a group as defined for $R^1$.

2. The photographic photosensitive material of claim 1, wherein the coupler of formula (I) and the coupler of formula (II) are present in a silver halide emulsion layer.

3. The photographic photosensitive material of claim 1, wherein the coupler of formula (I) and the coupler of formula (II) are present in a red sensitive silver halide emulsion layer.

4. The photographic photosensitive material of claim 1, wherein the coupler of formula (I) is present in a different layer form the layer in which the coupler of formula (II) is present.

5. The photographic photosensitive material of claim 1, wherein the proportion of the coupler of formula (I) is at least 90 wt % of the total amount of the coupler of formula (I) and of the coupler of formula (II).

6. The photographic photosensitive material of claim 1, wherein the amount of the coupler of formula (I) and of the coupler of formula (II) is 0.002 to 1 mol per mol of photosensitive silver halide.

7. The photographic photosensitive material of claim 1, wherein the coated silver weight is form 0.01 to 5 mmol per square meter of the photosensitive material.

8. The photographic photosensitive material of claim 1, wherein the silver halide of the silver halide emulsion layer is silver iodobromide, silver iodochloride or silver iodochlorobromide.

9. The photographic photosensitive material of claim 1, wherein the photosensitive material contains additionally at least one magenta coupler and yellow coupler.

10. The photographic photosensitive material of claim 1, wherein the cyan dye forming couplers represented by formulae (I) and (II) are mixed and dispersed in said material with a high boiling point organic solvent and the ratio by weight of said high boiling point organic solvent with respect to said cyan dye forming couplers represented by formulae (I) and (II) is at most 0.5.

11. The photographic photosensitive materials of claim 10, wherein the high boiling point organic solvent is a compound selected form the group consisting of carboxylic acid amides and phosphoric acid esters.

12. The photographic photosensitive material of claim 10, wherein the high boiling point organic solvent is a compound selected from the group consisting of phthalic acid esters, benzoic acid esters, fatty acid esters and chlorinated paraffins.

13. The photographic photosensitive material of claim 10, wherein the high boiling point organic solvent is a mixture of at least one compound selected form the group consisting of carboxylic acid amides and phosphoric acid esters and at least one compound selected form the group consisting of phthalic acid esters, benzoic acid esters, fatty acid esters and chlorinated paraffins.

14. The photographic photosensitive material of claim 1, wherein $R^1$ represents a linear chain or branched chain alkyl group having from 1-36 carbon atoms, a linear chain or branched chain alkenyl group having from 2-36 carbon atoms, a linear chain or branched chain alkynyl group having from 2-36 carbon atoms, a three to twelve membered cycloalkyl group having from 3-36 carbon atoms or an aryl group having from 6-36 carbon atoms and these groups may be substituted with substituent groups.

15. The photographic photosensitive material of claim 1, wherein $R^2$ in formula (I) is a halogen atom, an alkyl group having from 1-24 carbon atoms, a cycloalkyl group having from 3-24 carbon atoms, an alkoxy group having from 1-24 carbon atoms, a carbonamido group having from 2-24 carbon atoms or a sulfonamido group having from 1-24 carbon atoms.

16. The photographic photosensitive material of claim 1, wherein $R^2$ in formula (II) is a halogen atom, an alkyl group having from 1-24 carbon atoms, a cycloalkyl group having from 3-24 carbon atoms, an alkoxy group having from 1-24 carbon atoms, a carbonamido group having from 2-24 carbon atoms, an alkylsulfonyl group having from 1-24 carbon atoms, an arylsulfonyl group having from 6 -24 carbon atoms, an acyl group having from 1-24 carbon atoms, a sulfonamido group having from 1-24 carbon atoms, a carbamoyl group having from 1-24 carbon atoms, a sulfamoyl group having from 0-24 carbon, an aryl group having from 6-24 carbon atoms, or an alkoxycarbonyl group having from 2-24 carbon atoms.

17. The photographic photosensitive material of claim 1, wherein

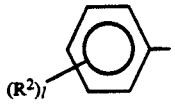

is represented by formula (III)

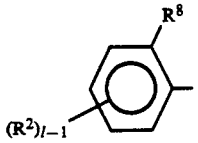

(III)

wherein $R^8$ has the same meaning as $R^2$.

18. The photographic photosensitive material of claim 1, wherein $R^4$ and $R^5$ each is a hydrogen atom, an alkyl group having from 1-24 carbon atoms, an alkenyl group having from 2-24 carbon atoms, an alkynyl group having from 2-24 carbon atoms, a cycloalkyl group having from 3-24 carbon atoms, an acyl group having from 1-24 carbon atoms, an alkoxycarbonyl group having from 2-24 carbon atoms or an aryl group having from 6-24 carbon atoms and the above-described groups other than the alkyl group may be substituted with substituent groups.

* * * * *